US008028401B2

(12) United States Patent
Sutardja

(10) Patent No.: US 8,028,401 B2
(45) Date of Patent: Oct. 4, 2011

(54) METHOD OF FABRICATING A CONDUCTING CROSSOVER STRUCTURE FOR A POWER INDUCTOR

(75) Inventor: Sehat Sutardja, Los Altos Hills, CA (US)

(73) Assignee: Marvell World Trade Ltd., St. Michael (BB)

( * ) Notice: Subject to any disclaimer, the term of this patent is extended or adjusted under 35 U.S.C. 154(b) by 0 days.

(21) Appl. No.: 11/367,176

(22) Filed: Mar. 3, 2006

(65) Prior Publication Data

US 2006/0158297 A1 Jul. 20, 2006

Related U.S. Application Data

(60) Division of application No. 10/875,903, filed on Jun. 24, 2004, now Pat. No. 7,307,502, which is a continuation-in-part of application No. 10/744,416, filed on Dec. 22, 2003, now Pat. No. 7,489,219, which is a continuation-in-part of application No. 10/621,128, filed on Jul. 16, 2003, now Pat. No. 7,023,313.

(51) Int. Cl.
*H01R 43/00* (2006.01)
*G10K 9/12* (2006.01)

(52) U.S. Cl. ..... 29/827; 29/844; 29/846; 29/847; 29/602.1; 336/174

(58) Field of Classification Search ..... 29/827, 29/852, 846, 831, 644, 832, 844, 602.1; 336/178, 336/174, 175, 233, 234; 445/49, 46, 35; 361/306.2, 303; 333/184, 138
See application file for complete search history.

(56) References Cited

U.S. PATENT DOCUMENTS

| | | | | | |
|---|---|---|---|---|---|
| 3,146,300 | A | * | 8/1964 | Beckius et al. | 174/127 |
| 3,305,697 | A | * | 2/1967 | Neusbaum | 315/244 |
| 3,579,214 | A | | 5/1971 | Solyst | |
| 3,599,325 | A | | 8/1971 | Burr et al. | |
| 3,766,308 | A | * | 10/1973 | Loro | 174/254 |
| 3,851,375 | A | | 12/1974 | Koomeef | |
| 4,020,439 | A | | 4/1977 | Thiessens et al. | |
| 4,031,496 | A | | 6/1977 | Fujiwara et al. | |
| 4,040,174 | A | | 8/1977 | Tsuda | 29/603 |
| 4,047,138 | A | * | 9/1977 | Steigerwald | 336/100 |
| 4,116,519 | A | | 9/1978 | Grabbe et al. | |
| 4,203,081 | A | * | 5/1980 | Braeckelmann | 333/138 |
| 4,313,152 | A | | 1/1982 | Vranken | |
| 4,371,912 | A | * | 2/1983 | Guzik | 361/679.31 |

(Continued)

FOREIGN PATENT DOCUMENTS

CN 1292636 A 4/2001

(Continued)

OTHER PUBLICATIONS

"Understanding Ferrite Bead Inductors", Http://www.murata.com, pp. 23-25 (unknown date of publication).

(Continued)

*Primary Examiner* — Derris H Banks
*Assistant Examiner* — Tai Nguyen

(57) ABSTRACT

A method of fabricating a conducting crossover structure for a power inductor comprises stamping a first lead frame to define a first terminal and a second terminal; stamping a second lead frame to define a first terminal and a second terminal; and locating an insulating material between and in contact with the first and second lead frames to form a laminate.

5 Claims, 18 Drawing Sheets

U.S. PATENT DOCUMENTS

| | | | | | |
|---|---|---|---|---|---|
| 4,475,143 | A | * | 10/1984 | Hernandez | 361/306.2 |
| 4,527,032 | A | * | 7/1985 | Young et al. | 219/645 |
| 4,536,733 | A | | 8/1985 | Shelly et al. | |
| 4,578,664 | A | | 3/1986 | Kinzler et al. | |
| 4,583,068 | A | | 4/1986 | Dickens et al. | |
| 4,616,205 | A | | 10/1986 | Praught et al. | 336/65 |
| 4,630,170 | A | * | 12/1986 | Kask et al. | 361/306.2 |
| 4,638,279 | A | | 1/1987 | Brisson et al. | |
| 4,641,112 | A | * | 2/1987 | Kohayakawa | 333/140 |
| 4,675,629 | A | | 6/1987 | Sakamoto et al. | |
| 4,728,810 | A | * | 3/1988 | Engel | 307/108 |
| 4,748,537 | A | * | 5/1988 | Hernandez et al. | 361/306.2 |
| 4,801,912 | A | * | 1/1989 | McElheny et al. | 336/84 M |
| 4,803,609 | A | | 2/1989 | Gillett et al. | |
| 5,057,805 | A | * | 10/1991 | Kadowaki | 333/247 |
| 5,175,525 | A | | 12/1992 | Smith | |
| 5,186,647 | A | * | 2/1993 | Denkmann et al. | 439/395 |
| 5,204,809 | A | | 4/1993 | Andresen | |
| 5,225,971 | A | | 7/1993 | Spreen | |
| 5,303,115 | A | * | 4/1994 | Nayar et al. | 361/106 |
| 5,359,313 | A | | 10/1994 | Watanabe et al. | |
| 5,362,257 | A | | 11/1994 | Neal et al. | 439/676 |
| 5,363,035 | A | | 11/1994 | Hutchison et al. | |
| 5,399,106 | A | | 3/1995 | Ferry | |
| 5,400,006 | A | | 3/1995 | Cardozo | |
| 5,403,196 | A | | 4/1995 | Northey et al. | |
| 5,403,208 | A | | 4/1995 | Felcman et al. | |
| 5,410,180 | A | | 4/1995 | Fujii et al. | |
| 5,444,600 | A | * | 8/1995 | Dobkin et al. | 361/303 |
| 5,461,255 | A | | 10/1995 | Chan et al. | |
| 5,481,238 | A | | 1/1996 | Carsten et al. | |
| 5,500,629 | A | | 3/1996 | Meyer | |
| 5,509,691 | A | | 4/1996 | Kaule et al. | 283/67 |
| 5,526,565 | A | | 6/1996 | Roberts | 29/884 |
| 5,554,050 | A | | 9/1996 | Marpoe, Jr. | |
| 5,586,914 | A | | 12/1996 | Foster et al. | 439/676 |
| 5,611,700 | A | | 3/1997 | Mitra | |
| 5,650,357 | A | * | 7/1997 | Dobkin et al. | 438/107 |
| 5,684,445 | A | | 11/1997 | Kobayashi et al. | |
| 5,764,500 | A | | 6/1998 | Matos | |
| 5,781,093 | A | * | 7/1998 | Grandmont et al. | 336/232 |
| 5,802,709 | A | * | 9/1998 | Hogge et al. | 29/827 |
| 5,808,537 | A | | 9/1998 | Kondo et al. | |
| 5,834,691 | A | * | 11/1998 | Aoki | 174/529 |
| 5,889,373 | A | | 3/1999 | Fisher et al. | |
| 5,909,037 | A | | 6/1999 | Rajkomar et al. | |
| 5,926,358 | A | | 7/1999 | Dobkin et al. | |
| 6,018,468 | A | | 1/2000 | Archer et al. | |
| 6,046,662 | A | | 4/2000 | Schroter et al. | |
| 6,049,264 | A | | 4/2000 | Salier et al. | |
| 6,054,764 | A | | 4/2000 | Howser et al. | 257/724 |
| 6,087,715 | A | * | 7/2000 | Sawada et al. | 257/666 |
| 6,114,932 | A | | 9/2000 | Wester et al. | |
| 6,137,389 | A | | 10/2000 | Uchikoba | |
| 6,144,269 | A | * | 11/2000 | Okamoto et al. | 333/184 |
| 6,184,579 | B1 | * | 2/2001 | Sasov | 257/712 |
| 6,191,673 | B1 | | 2/2001 | Ogura et al. | |
| 6,201,186 | B1 | | 3/2001 | Daniels et al. | |
| 6,225,727 | B1 | | 5/2001 | Oohashi et al. | |
| 6,287,164 | B1 | | 9/2001 | Radloff | |
| 6,310,534 | B1 | | 10/2001 | Brunner | |
| 6,356,179 | B1 | | 3/2002 | Yamada | |
| 6,362,986 | B1 | | 3/2002 | Schultz et al. | |
| 6,383,845 | B2 | | 5/2002 | Masuda et al. | |
| 6,404,066 | B1 | * | 6/2002 | Tsuji et al. | 257/783 |
| 6,438,000 | B1 | | 8/2002 | Okamoto et al. | |
| 6,459,349 | B1 | | 10/2002 | Giday et al. | |
| 6,483,623 | B1 | | 11/2002 | Maruyama | 398/182 |
| 6,512,437 | B2 | | 1/2003 | Jin et al. | |
| 6,522,233 | B1 | | 2/2003 | Kyoso et al. | |
| 6,556,456 | B1 | | 4/2003 | Takehara | |
| 6,583,697 | B2 | | 6/2003 | Koyama et al. | 336/83 |
| 6,612,890 | B1 | | 9/2003 | Radloff | |
| 6,661,091 | B1 | * | 12/2003 | Bando | 257/723 |
| 6,683,522 | B2 | | 1/2004 | Walsh | |
| 6,686,823 | B2 | | 2/2004 | Arntz et al. | |
| 6,820,321 | B2 | | 11/2004 | Harding | |
| 6,879,237 | B1 | | 4/2005 | Viarouge et al. | |
| 6,967,553 | B2 | | 11/2005 | Jitaru | |
| 2001/0052837 | A1 | | 12/2001 | Walsh | |
| 2002/0039061 | A1 | | 4/2002 | Timashov | |
| 2002/0109782 | A1 | | 8/2002 | Ejima et al. | |
| 2002/0140464 | A1 | | 10/2002 | Yampolsky et al. | |
| 2002/0157117 | A1 | | 10/2002 | Geil et al. | |
| 2003/0011371 | A1 | | 1/2003 | Rosthal et al. | |
| 2003/0227366 | A1 | | 12/2003 | Lin | |
| 2005/0016815 | A1 | | 1/2005 | Martin et al. | 194/317 |
| 2006/0116623 | A1 | | 6/2006 | Han et al. | |

FOREIGN PATENT DOCUMENTS

| | | | |
|---|---|---|---|
| DE | 3622190 | A | 1/1988 |
| EP | 0484074 | A | 5/1992 |
| EP | 0895257 | A | 2/1999 |
| FR | 2620852 | | 3/1989 |
| GB | 2318691 | A | 4/1998 |
| JP | 57089212 | | 6/1982 |
| JP | 57193007 | | 11/1982 |
| JP | 57191011 | | 12/1982 |
| JP | 58224420 | | 12/1983 |
| JP | 58224420 | A | 12/1983 |
| JP | 59009526 | | 1/1984 |
| JP | 61078111 | A | 4/1986 |
| JP | 63006712 | | 1/1988 |
| JP | 02125404 | A | 5/1990 |
| JP | 02251107 | | 10/1990 |
| JP | 04-062807 | | 2/1992 |
| JP | 5267064 | | 10/1993 |
| JP | 06260869 | | 9/1994 |
| JP | 8-69934 | A | 3/1996 |
| JP | 8107021 | | 4/1996 |
| JP | 6061707 | | 8/1997 |
| JP | 10335146 | | 12/1998 |
| JP | 11008123 | | 1/1999 |
| JP | 11074125 | A | 3/1999 |
| JP | 11186045 | | 7/1999 |
| JP | 11204354 | A | 7/1999 |
| JP | 11233348 | | 8/1999 |
| JP | 11273975 | | 8/1999 |
| JP | 11354329 | | 12/1999 |
| JP | 2002057039 | | 2/2002 |
| JP | 2002057049 | | 2/2002 |
| JP | 2002075737 | | 3/2002 |
| JP | 2003124015 | | 4/2003 |
| JP | 2003142319 | | 5/2003 |
| JP | 2003332141 | A | 11/2003 |
| JP | 2003347130 | | 12/2003 |
| JP | 2006095956 | | 4/2006 |
| TW | 403917 | | 9/2000 |
| TW | 445467 | | 7/2001 |
| WO | WO00/74089 | A1 | 12/2000 |
| WO | WO02/25677 | A2 | 3/2002 |
| WO | WO02/095775 | A | 11/2002 |
| WO | WO02/095775 | A1 | 11/2002 |

OTHER PUBLICATIONS

"Using Ferrite Beads to Keep RF Out Of TV Sets, Telephones, VCR's, Burglar Alarms and Other Electronic Equipment", http://www.antennex.com, pp. 1-4 (unknown date of publication).

European Search Report for Application No. 04020571.8, 3 pages.

European Search Report for Application No. 04030568,.4, 3 pages.

European Search Report for Application No. 04010841, 2 pages.

European Search Report for Application No. 04011558.6, 2 pages.

Organized Translation of Non-Final Rejection from the Japanese Patent Office dated Apr. 14, 2009; 5 pages.

Decision from the Japan Patent Office dated Jan. 12, 2010 for Application No. 2004-178924; 8 pages.

Decision from the Japan Patent Office dated Nov. 24, 2009 for Application No. 2004-254991; 7 pages.

Non-Final Rejection from the Japan Patent Office dated Sep. 8, 2009 for Application No. 2004-178924; 12 pages.

Official Communication from the European Patent Office dated Dec. 22, 2009 for Application No. 04 020 568.4-1231; 6 pages.

Official Communication from the European Patent Office dated Dec. 21, 2009 for Application No. 04 011 558.6; 5 pages.

Official Communication from the European Patent Office dated Dec. 18, 2009 for Application No. 04 010 841.7- 1231; 5 pages.
Official Communication from the European Patent Office dated Jan. 10, 2010 for Application No. 04 020 571.8; 5 pages.
Non-Final Rejection from the Japan Patent Office dated Apr. 16, 2010 for Application No. 2005-183998; 18 pages.
First Office Action from the Taiwan Intellectual Property Office dated Feb. 9, 2010 for Application No. 93127468; 12 pages.
First Office Action from the Taiwan Intellectual Property Office dated May 6, 2010 for Application No. 93108084; 17 pages.

* cited by examiner

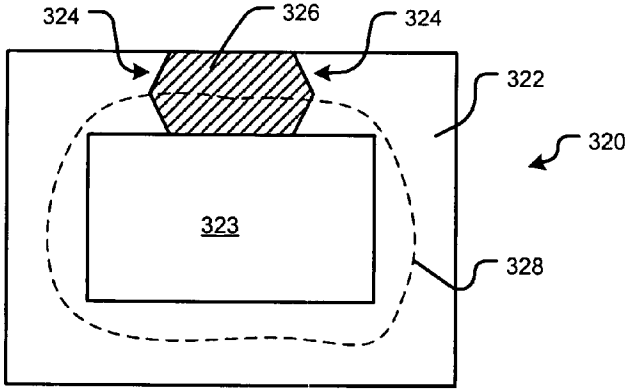
FIG. 25
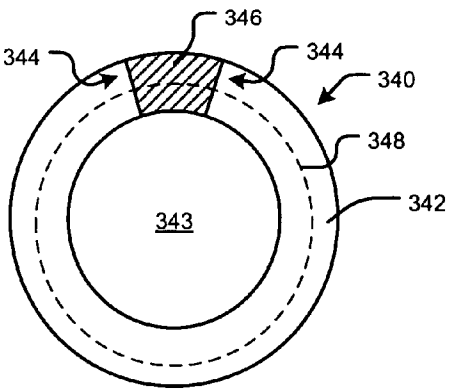
FIG. 26
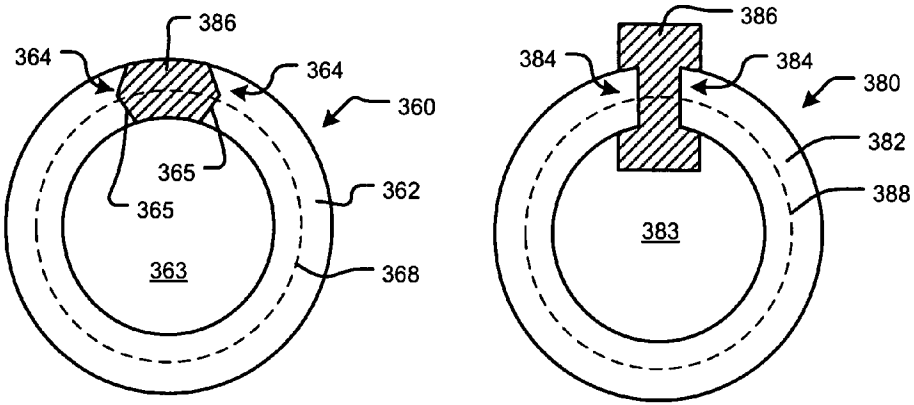
FIG. 27
FIG. 28
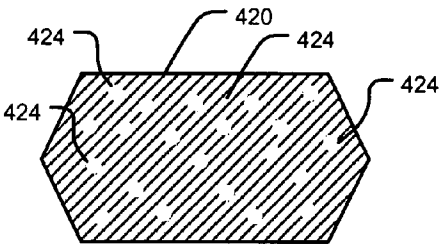
FIG. 29

700
644-N
644-6
644-5
644-4
644-3
644-2
644-1
713
648
712-1
710-1
714
712-2
710-2
L1

704
646-N
646-6
646-5
646-4
646-3
646-2
646-1
712-3
710-3
710-4
712-4
713
714
L2

METHOD OF FABRICATING A CONDUCTING CROSSOVER STRUCTURE FOR A POWER INDUCTOR

CROSS-REFERENCE TO RELATED APPLICATIONS

This application is a divisional of U.S. patent application Ser. No. 10/875,903, filed on Jun. 24, 2004, which is a continuation-in-part of U.S. patent application Ser. No. 10/744,416, filed on Dec. 22, 2003, which is a continuation-in-part of U.S. patent application Ser. No. 10/621,128 filed on Jul. 16, 2003, all of which are incorporated herein by reference in their entirety.

FIELD OF THE INVENTION

The present invention relates to inductors, and more particularly to power inductors having magnetic core materials with reduced levels of saturation when operating with high DC currents and at high operating frequencies.

BACKGROUND OF THE INVENTION

Inductors are circuit elements that operate based on magnetic fields. The source of the magnetic field is charge that is in motion, or current. If current varies with time, the magnetic field that is induced also varies with time. A time-varying magnetic field induces a voltage in any conductor that is linked by the magnetic field. If the current is constant, the voltage across an ideal inductor is zero. Therefore, the inductor looks like a short circuit to a constant or DC current. In the inductor, the voltage is given by:

$$v = L\frac{di}{dt}.$$

Therefore, there cannot be an instantaneous change of current in the inductor.

Inductors can be used in a wide variety of circuits. Power inductors receive a relatively high DC current, for example up to about 100 Amps, and may operate at relatively high frequencies. For example and referring now to FIG. 1, a power inductor 20 may be used in a DC/DC converter 24, which typically employs inversion and/or rectification to transform DC at one voltage to DC at another voltage.

Referring now to FIG. 2, the power inductor 20 typically includes one or more turns of a conductor 30 that pass through a magnetic core material 34. For example, the magnetic core material 34 may have a square outer cross-section 36 and a square central cavity 38 that extends the length of the magnetic core material 34. The conductor 30 passes through the central cavity 38. The relatively high levels of DC current that flow through the conductor 30 tend to cause the magnetic core material 34 to saturate, which reduces the performance of the power inductor 20 and the device incorporating it.

SUMMARY OF THE INVENTION

A power inductor according to the present invention includes a first magnetic core material having first and second ends. An inner cavity is arranged in the first magnetic core material that extends from the first end to the second end. A first notch is arranged in the first magnetic core material that projects inwardly towards the inner cavity from one of the first and second ends. A first conductor passes through the inner cavity and is received by the first notch.

In other features, a second notch is arranged in the first magnetic core material that projects inwardly towards the inner cavity from the other of the first and second ends. The first conductor is also received by the second notch. The first conductor is not insulated. A third notch is arranged in the first magnetic core material that projects inwardly towards the inner cavity from the one of the first and second ends. A fourth notch is arranged in the first magnetic core material that projects inwardly towards the inner cavity from the other of the first and second ends. A second conductor passes through the inner cavity and is received by the third and fourth notches.

In still other features of the invention, the first conductor passes through the inner cavity at least two times and is also received by the third and fourth notches. An additional 2n+1 notches are arranged in the first magnetic core material that project inwardly towards the inner cavity. The first conductor is also received by the 2n+1 additional notches. The first conductor passes through the inner cavity n+1 times. A slotted air gap in the first magnetic core material extends from the first end to the second end. An eddy current reducing material is arranged adjacent to at least one of an inner opening of the slotted air gap in the inner cavity between the slotted air gap and the first conductor and an outer opening of the slotted air gap. The eddy current reducing material has a permeability that is lower than the first magnetic core material.

In yet other features, a second notch is arranged in the first magnetic core material that projects inwardly from one of the first and second ends. A second conductor passes through the inner cavity and is received by the second notch. A projection of the first magnetic core material extends outwardly from a first side of the first magnetic core material between the first and second conductors. The eddy current reducing material has a low magnetic permeability. The eddy current reducing material comprises a soft magnetic material. The soft magnetic material comprises a powdered metal. The first conductor includes an insulating material arranged on an outer surface thereof. A cross-sectional shape of the first magnetic core material is one of square, circular, rectangular, elliptical, and oval. A DC/DC converter comprises the power inductor.

In still other features of the invention, a first end of the first conductor begins and a second end of the first conductor ends along an outer side of the first magnetic core material. A system comprises the power inductor and further comprises a printed circuit board. The first and second ends of the first conductor are surface mounted on the printed circuit board. First and second ends of the first conductor project outwardly from the first magnetic core material. The first and second ends of the first conductor are surface mounted on the printed circuit board in a gull wing configuration.

In yet other features, a system comprises the power inductor and further comprises a printed circuit board. The at least one of the first and second ends of the first conductor are received in plated-through holes of the printed circuit board. A cross-sectional shape of the first notch is one of square, circular, rectangular, elliptical, oval, and terraced. A second magnetic core material is located at least one of in and adjacent to the slotted air gap. The first magnetic core material comprises a ferrite bead core material. The first magnetic core material and the second magnetic core material are self-locking in at least two orthogonal planes. Opposing walls of the first magnetic core material that are adjacent to the slotted air gap are "V"-shaped. The second magnetic core material is "T"-shaped and extends along an inner wall of the first magnetic core material.

In still other features of the invention, the second magnetic core material is "H"-shaped and extends partially along inner and outer walls of the first magnetic core material. The second magnetic core material includes ferrite bead core material with distributed gaps that lower a permeability of the second magnetic core material. The distributed gaps include distributed air gaps. Flux flows through a magnetic path in the power inductor that includes the first and second magnetic core materials. The second magnetic core material is less than 30% of the magnetic path.

In yet other features, flux flows through a magnetic path in the power inductor that includes the first and second core materials. The second magnetic core material is less than 20% of the magnetic path. The first and second magnetic core materials are attached together using at least one of adhesive and a strap. The first notch is formed in the first magnetic core material during molding and before sintering.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein:

FIG. 25 is a cross sectional view of a "C"-shaped first magnetic core including a ferrite bead core material with a self-locking second magnetic core located in an air gap thereof;

FIG. 26 illustrates an "O"-shaped first magnetic core including a ferrite bead core material with a second magnetic core located in an air gap thereof;

FIGS. 27 and 28 illustrate "O"-shaped first magnetic cores including ferrite bead core material with self-locking second magnetic cores located in air gaps thereof;

FIG. 29 illustrates a second magnetic core that includes ferrite bead core material having distributed gaps that reduce the permeability of the second magnetic core;

DETAILED DESCRIPTION OF THE PREFERRED EMBODIMENTS

Figure 1:
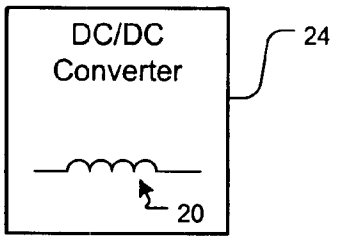
FIG. 1 Prior Art
FIG. 1 is a functional block diagram and electrical schematic of a power inductor implemented in an exemplary DC/DC converter according to the prior art.
Figure 3:
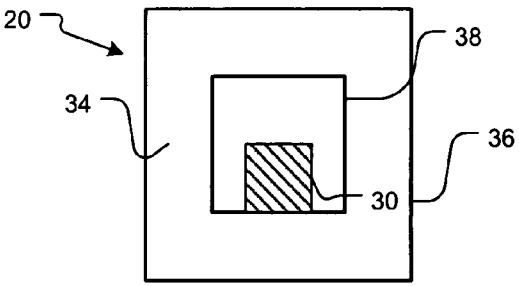
FIG. 3 Prior Art
FIG. 3 is a cross sectional view showing the power inductor of FIGS. 1 and 2 according to the prior art.
Figure 2:
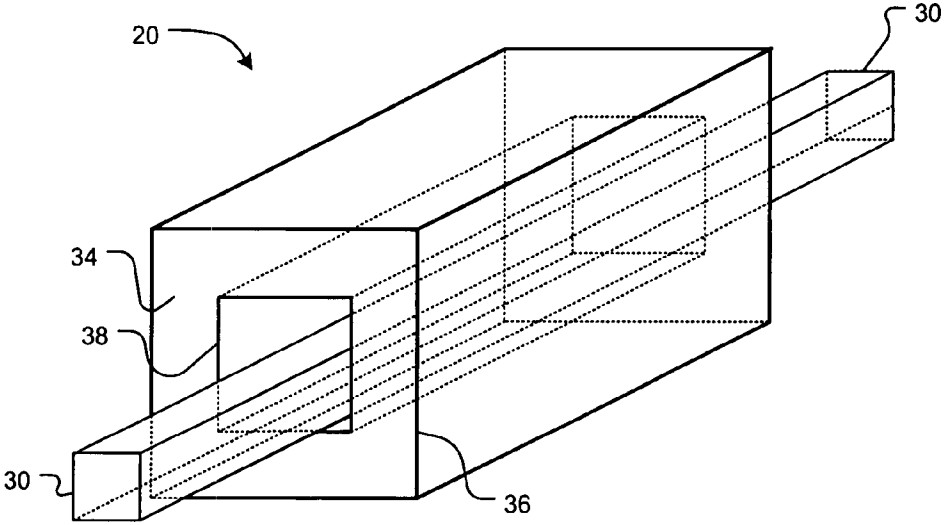
FIG. 2 Prior Art
FIG. 2 is a perspective view showing the power inductor of FIG. 1 according to the prior art.

The following description of the preferred embodiment(s) is merely exemplary in nature and is in no way intended to limit the invention, its application, or uses. For purposes of clarity, the same reference numbers will be used in the drawings to identify the same elements.

Figure 4:
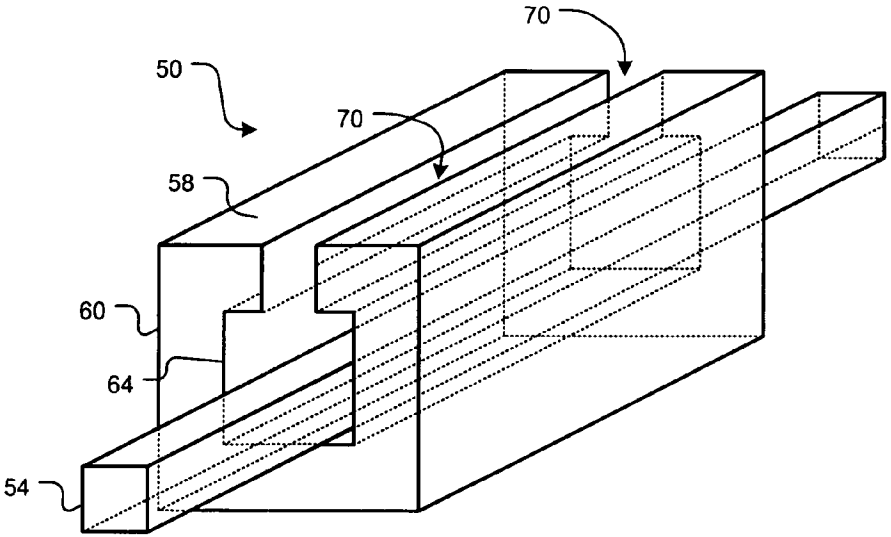
FIG. 4 is a perspective view showing a power inductor with a slotted air gap arranged in the magnetic core material according to the present invention.

Referring now to FIG. 4, a power inductor 50 includes a conductor 54 that passes through a magnetic core material 58. For example, the magnetic core material 58 may have a square outer cross-section 60 and a square central cavity 64 that extends the length of the magnetic core material. The conductor 54 may also have a square cross section. While the square outer cross section 60, the square central cavity 64, and the conductor 54 are shown, skilled artisans will appreciate that other shapes may be employed. The cross sections of the square outer cross section 60, the square central cavity 64, and the conductor 54 need not have the same shape. The conductor 54 passes through the central cavity 64 along one side of the cavity 64. The relatively high levels of DC current that flow through the conductor 30 tend to cause the magnetic core material 34 to saturate, which reduces performance of the power inductor and/or the device incorporating it.

According to the present invention, the magnetic core material 58 includes a slotted air gap 70 that runs lengthwise along the magnetic core material 58. The slotted air gap 70 runs in a direction that is parallel to the conductor 54. The slotted air gap 70 reduces the likelihood of saturation in the magnetic core material 58 for a given DC current level.

Figure 5:
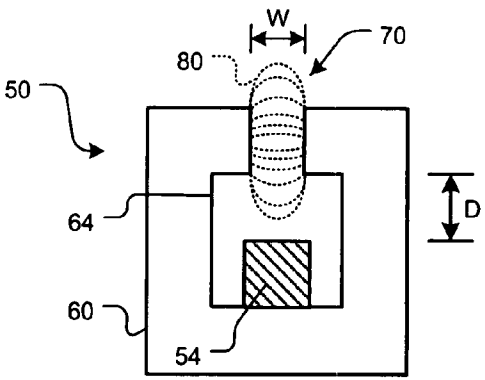
FIG. 5 is a cross sectional view of the power inductor of FIG. 4.

Referring now to FIG. 5, magnetic flux 80-1 and 80-2 (collectively referred to as flux 80) is created by the slotted air gap 70. Magnetic flux 80-2 projects towards the conductor 54 and induces eddy currents in the conductor 54. In a preferred embodiment, a sufficient distance "D" is defined between the conductor 54 and a bottom of the slotted air gap 70 such that the magnetic flux is substantially reduced. In one exemplary embodiment, the distance D is related to the current flowing through the conductor, a width "W" that is defined by the slotted air gap 70, and a desired maximum acceptable eddy current that can be induced in the conductor 54.

Figure 6B:
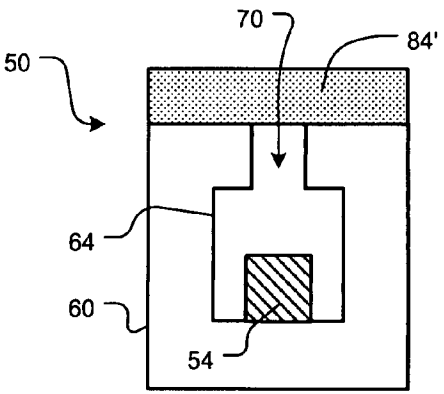
FIGS. 6A and 6B are cross sectional views showing alternate embodiments with an eddy current reducing material that is arranged adjacent to the slotted air gap.
Figure 6A:
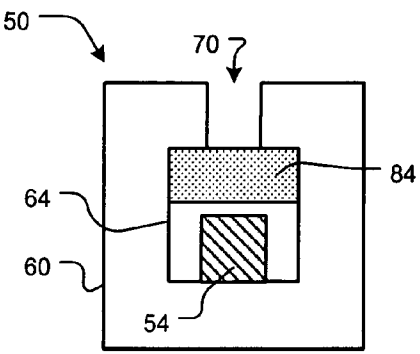

Referring now to FIGS. 6A and 6B, an eddy current reducing material 84 can be arranged adjacent to the slotted air gap 70. The eddy current reducing material has a lower magnetic permeability than the magnetic core material and a higher permeability than air. As a result, more magnetic flux flows through the material 84 than air. For example, the magnetic insulating material 84 can be a soft magnetic material, a powdered metal, or any other suitable material. In FIG. 6A, the eddy current reducing material 84 extends across a bottom opening of the slotted air gap 70.

In FIG. 6B, the eddy current reducing material 84' extends across an outer opening of the slotted air gap. Since the eddy current reducing material 84' has a lower magnetic permeability than the magnetic core material and a higher magnetic permeability than air, more flux flows through the eddy current reducing material than the air. Thus, less of the magnetic flux that is generated by the slotted air gap reaches the conductor.

Figure 7:
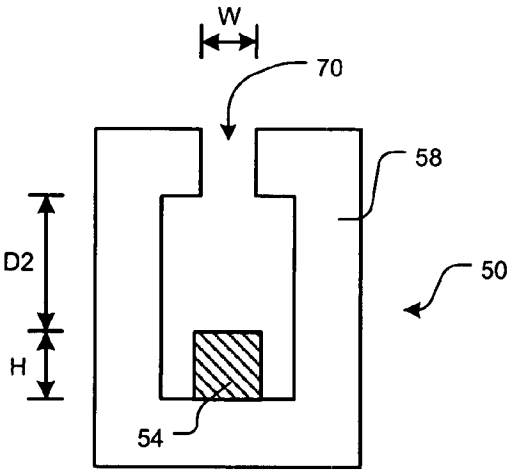
FIG. 7 is a cross sectional view showing an alternate embodiment with additional space between the slotted air gap and a top of the conductor.

For example, the eddy current reducing material 84 can have a relative permeability of 9 while air in the air gap has a relative permeability of 1. As a result, approximately 90% of the magnetic flux flows through the material 84 and approximately 10% of the magnetic flux flows through the air. As a result, the magnetic flux reaching the conductor is significantly reduced, which reduces induced eddy currents in the conductor. As can be appreciated, other materials having other permeability values can be used. Referring now to FIG. 7, a distance "D2" between a bottom the slotted air gap and a top of the conductor 54 can also be increased to reduce the magnitude of eddy currents that are induced in the conductor 54.

Figure 8:
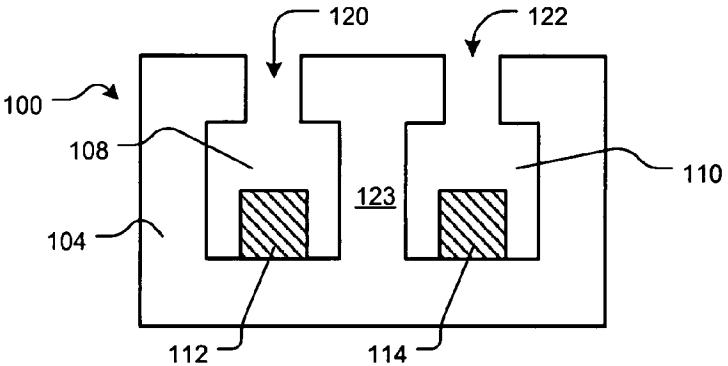
FIG. 8 is a cross sectional view of a magnetic core with multiple cavities each with a slotted air gap.

Referring now to FIG. 8, a power inductor 100 includes a magnetic core material 104 that defines first and second cavities 108 and 110. First and second conductors 112 and 114 are arranged in the first and second cavities 108 and 110, respectively. First and second slotted air gaps 120 and 122 are arranged in the magnetic core material 104 on a side that is across from the conductors 112 and 114, respectively. The first and second slotted air gaps 120 and 122 reduce saturation of the magnetic core material 104. In one embodiment, mutual coupling M is in the range of 0.5.

Figure 9A:
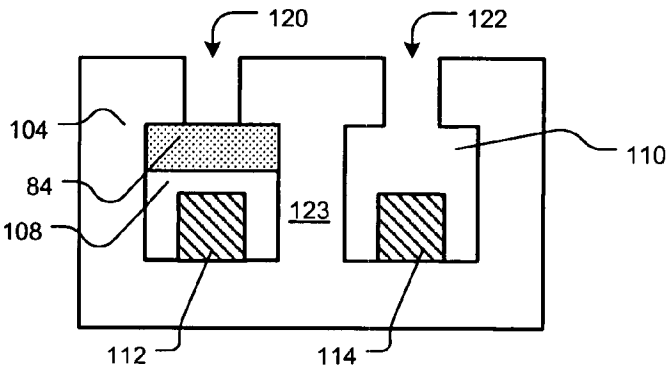
FIGS. 9A and 9B are cross sectional views of FIG. 8 with an eddy current reducing material arranged adjacent to one or both of the slotted air gaps.
Figure 9B:
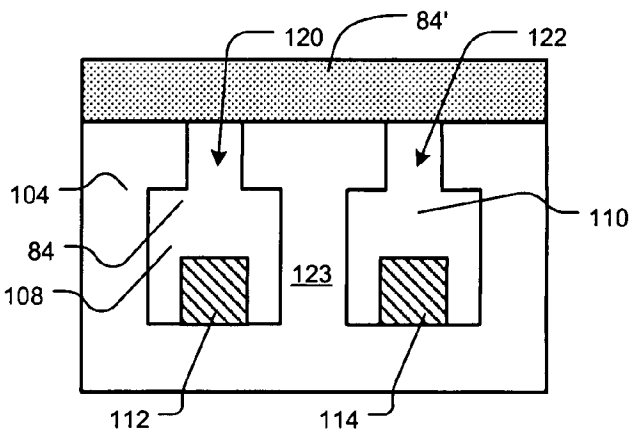

Referring now to FIGS. 9A and 9B, an eddy current reducing material is arranged adjacent to one or more of the slotted air gaps 120 and/or 122 to reduce magnetic flux caused by the slotted air gaps, which reduces induced eddy currents. In FIG. 9A, the eddy current reducing material 84 is located adjacent to a bottom opening of the slotted air gaps 120. In FIG. 9B, the eddy current reducing material is located adjacent to a top opening of both of the slotted air gaps 120 and 122. As can be appreciated, the eddy current reducing material can be located adjacent to one or both of the slotted air gaps. "T"-shaped central section 123 of the magnetic core material separates the first and second cavities 108 and 110.

Figure 10A:
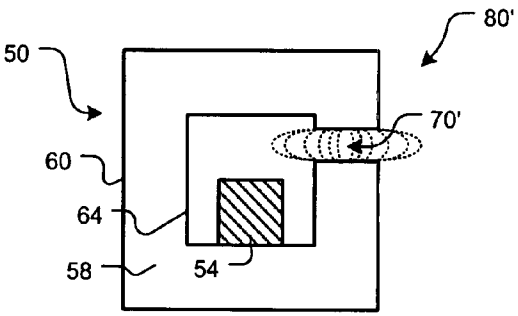
FIG. 10A is a cross sectional view showing an alternate side location for the slotted air gap.
Figure 10B:
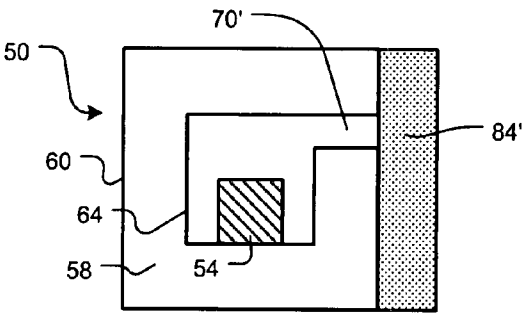
FIG. 10B is a cross sectional view showing an alternate side location for the slotted air gap.

The slotted air gap can be located in various other positions. For example and referring now to FIG. 10A, a slotted air gap 70' can be arranged on one of the sides of the magnetic core material 58. A bottom edge of the slotted air gap 70' is preferably but not necessarily arranged above a top surface of the conductor 54. As can be seen, the magnetic flux radiates inwardly. Since the slotted air gap 70' is arranged above the conductor 54, the magnetic flux has a reduced impact. As can be appreciated, the eddy current reducing material can arranged adjacent to the slotted air gap 70' to further reduce the magnetic flux as shown in FIGS. 6A and/or 6B. In FIG. 10B, the eddy current reducing material 84' is located adjacent to an outer opening of the slotted air gap 70'. The eddy current reducing material 84 can be located inside of the magnetic core material 58 as well.

Figure 11A:
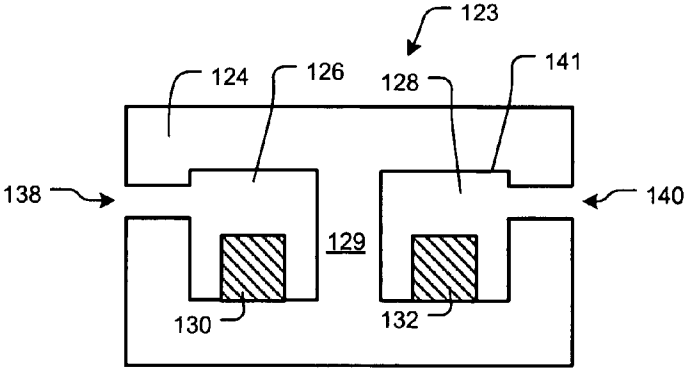
FIGS. 11A and 11B are cross sectional views of a magnetic core with multiple cavities each with a side slotted air gap.
Figure 11B:
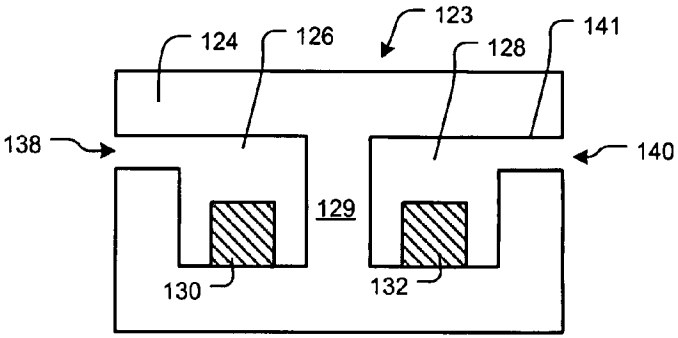

Referring now to FIGS. 11A and 11B, a power inductor 123 includes a magnetic core material 124 that defines first and second cavities 126 and 128, which are separated by a central portion 129. First and second conductors 130 and 132 are arranged in the first and second cavities 126 and 128, respectively, adjacent to one side. First and second slotted air gaps 138 and 140 are arranged in opposite sides of the magnetic core material adjacent to one side with the conductors 130 and 132. The slotted air gaps 138 and/or 140 can be aligned with an inner edge 141 of the magnetic core material 124 as shown in FIG. 11B or spaced from the inner edge 141 as shown in FIG. 11A. As can be appreciated, the eddy current reducing material can be used to further reduce the magnetic flux emanating from one or both of the slotted air gaps as shown in FIGS. 6A and/or 6B.

Figure 12:
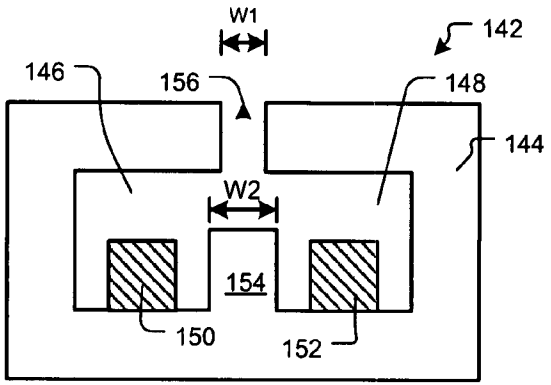
FIG. 12 is a cross sectional view of a magnetic core with multiple cavities and a central slotted air gap.
Figure 13:
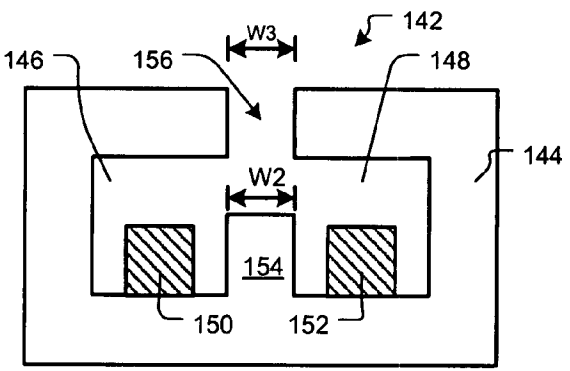
FIG. 13 is a cross sectional view of a magnetic core with multiple cavities and a wider central slotted air gap.
Figure 14:
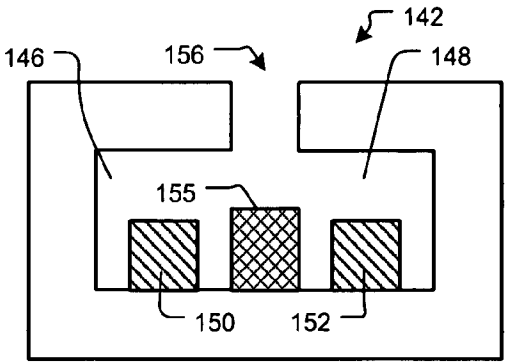
FIG. 14 is a cross sectional view of a magnetic core with multiple cavities, a central slotted air gap and a material having a lower permeability arranged between adjacent conductors.
Figure 15:
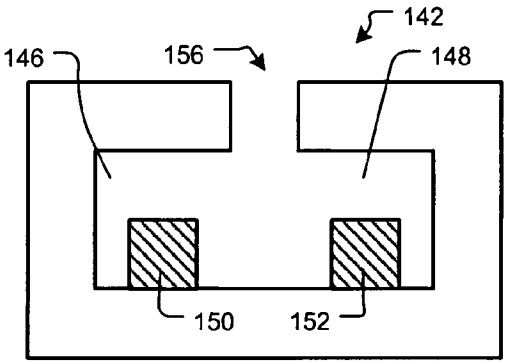
FIG. 15 is a cross sectional view of a magnetic core with multiple cavities and a central slotted air gap.

Referring now to FIGS. 12 and 13, a power inductor 142 includes a magnetic core material 144 that defines first and second connected cavities 146 and 148. First and second conductors 150 and 152 are arranged in the first and second cavities 146 and 148, respectively. A projection 154 of the magnetic core material 144 extends upwardly from a bottom side of the magnetic core material between the conductors 150 and 152. The projection 154 extends partially but not fully towards to a top side. In a preferred embodiment, the projection 154 has a projection length that is greater than a height of the conductors 150 and 154. As can be appreciated, the projection 154 can also be made of a material having a lower permeability than the magnetic core and a higher permeability than air as shown at 155 in FIG. 14. Alternately, both the projection and the magnetic core material can be removed as shown in FIG. 15. In this embodiment, the mutual coupling M is approximately equal to 1.

In FIG. 12, a slotted air gap 156 is arranged in the magnetic core material 144 in a location that is above the projection 154. The slotted air gap 156 has a width W1 that is less than a width W2 of the projection 154. In FIG. 13, a slotted air gap 156' is arranged in the magnetic core material in a location that is above the projection 154. The slotted air gap 156 has a width W3 that is greater than or equal to a width W2 of the projection 154. As can be appreciated, the eddy current reducing material can be used to further reduce the magnetic flux emanating from the slotted air gaps 156 and/or 156' as shown in FIGS. 6A and/or 6B. In some implementations of FIGS. 12-14, mutual coupling M is in the range of 1.

Figure 16:
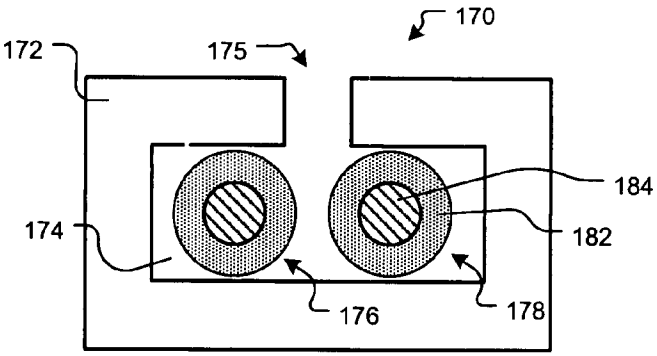
FIG. 16 is a cross sectional view of a magnetic core material with a slotted air gap and one or more insulated conductors.

Referring now to FIG. 16, a power inductor 170 is shown and includes a magnetic core material 172 that defines a cavity 174. A slotted air gap 175 is formed in one side of the magnetic core material 172. One or more insulated conductors 176 and 178 pass through the cavity 174. The insulated conductors 176 and 178 include an outer layer 182 surrounding an inner conductor 184. The outer layer 182 has a higher permeability than air and lower than the magnetic core material. The outer material 182 significantly reduces the magnetic flux caused by the slotted air gap and reduces eddy currents that would otherwise be induced in the conductors 184.

Figure 17:
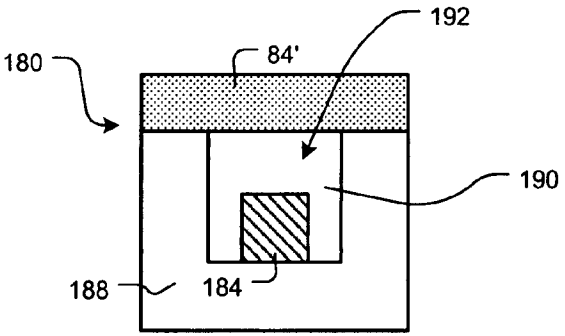
FIG. 17 is a cross sectional view of a "C"-shaped magnetic core material and an eddy current reducing material.
Figure 18:
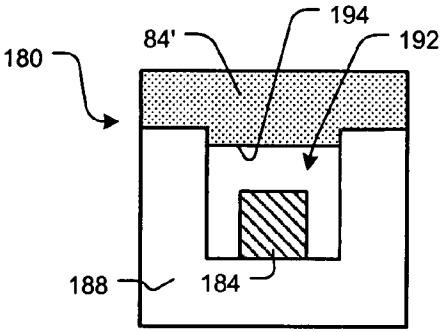
FIG. 18 is a cross sectional view of a "C"-shaped magnetic core material and an eddy current reducing material with a mating projection.

Referring now to FIG. 17, a power inductor 180 includes a conductor 184 and a "C"-shaped magnetic core material 188 that defines a cavity 190. A slotted air gap 192 is located on one side of the magnetic core material 188. The conductor 184 passes through the cavity 190. An eddy current reducing material 84' is located across the slotted air gap 192. In FIG. 18, the eddy current reducing material 84' includes a projection 194 that extends into the slotted air gap and that mates with the opening that is defined by the slotted air gap 192.

Figure 19:
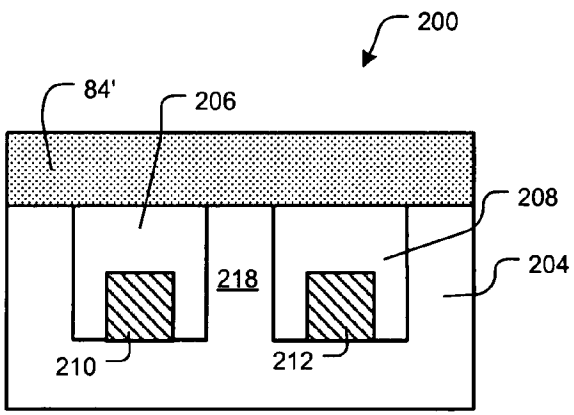
FIG. 19 is a cross sectional view of a "C"-shaped magnetic core material with multiple cavities and an eddy current reducing material.

Referring now to FIG. 19, the power inductor 200 a magnetic core material that defines first and second cavities 206 and 208. First and second conductors 210 and 212 pass through the first and second cavities 206 and 208, respectively. A center section 218 is located between the first and second cavities. As can be appreciated, the center section 218 may be made of the magnetic core material and/or an eddy current reducing material. Alternately, the conductors may include an outer layer.

The conductors may be made of copper, although gold, aluminum, and/or other suitable conducting materials having a low resistance may be used. The magnetic core material can be Ferrite although other magnetic core materials having a high magnetic permeability and a high electrical resistivity can be used. As used herein, Ferrite refers to any of several magnetic substances that include ferric oxide combined with the oxides of one or more metals such as manganese, nickel, and/or zinc. If Ferrite is employed, the slotted air gap can be cut with a diamond cutting blade or other suitable technique.

While some of the power inductors that are shown have one turn, skilled artisans will appreciate that additional turns may be employed. While some of the embodiments only show a magnetic core material with one or two cavities each with one or two conductors, additional conductors may be employed in each cavity and/or additional cavities and conductors may be employed without departing from the invention. While the shape of the cross section of the inductor has be shown as square, other suitable shapes, such as rectangular, circular, oval, elliptical and the like are also contemplated.

The power inductor in accordance with the present embodiments preferably has the capacity to handle up to 100 Amps (A) of DC current and has an inductance of 500 nH or less. For example, a typical inductance value of 50 nH is used. While the present invention has been illustrated in conjunction with DC/DC converters, skilled artisans will appreciate that the power inductor can be used in a wide variety of other applications.

Figure 20:
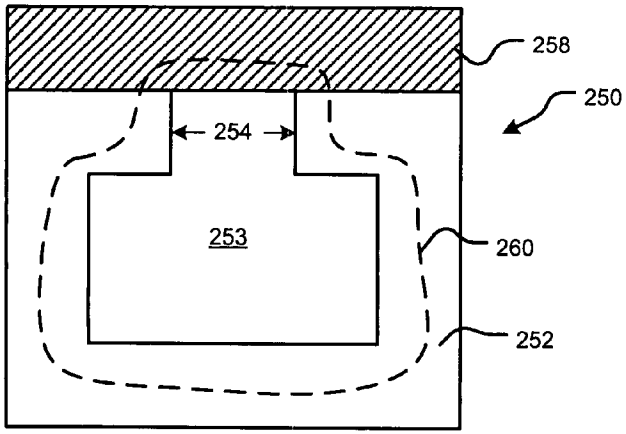
FIG. 20 is a cross sectional view of a "C"-shaped first magnetic core including a ferrite bead core material and a second magnetic core located adjacent to an air gap thereof.

Referring now to FIG. 20, a power inductor 250 includes a "C"-shaped first magnetic core 252 that defines a cavity 253. While a conductor is not shown in FIGS. 20-28, skilled artisans will appreciate that one or more conductors pass through the center of the first magnetic core as shown and described above. The first magnetic core 252 is preferably fabricated from ferrite bead core material and defines an air gap 254. A second magnetic core 258 is attached to at least one surface of the first magnetic core 252 adjacent to the air gap 254. In some implementations, the second magnetic core 258 has a permeability that is lower than the ferrite bead core material. Flux flows 260 through the first and second magnetic cores 252 and 258 as shown by dotted lines.

Figure 21:
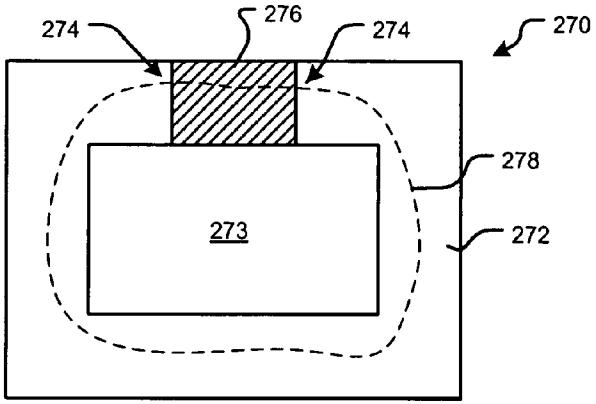
FIG. 21 is a cross sectional view of a "C"-shaped first magnetic core including a ferrite bead core material and a second magnetic core located in an air gap thereof.

Referring now to FIG. 21, a power inductor 270 includes a "C"-shaped first magnetic core 272 that is made of a ferrite bead core material. The first magnetic core 272 defines a cavity 273 and an air gap 274. A second magnetic core 276 is located in the air gap 274. In some implementations, the second magnetic core has a permeability that is lower than the ferrite bead core material. Flux 278 flows through the first and second magnetic cores 272 and 276, respectively, as shown by the dotted lines.

Figure 22:
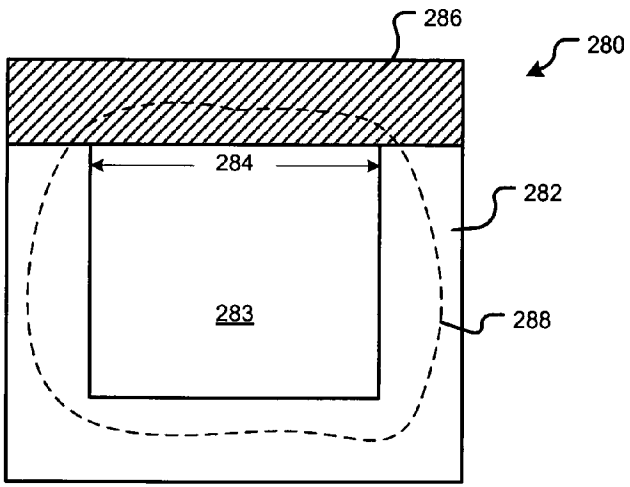
FIG. 22 is a cross sectional view of a "U"-shaped first magnetic core including a ferrite bead core material with a second magnetic core located adjacent to an air gap thereof.

Referring now to FIG. 22, a power inductor 280 includes a "U"-shaped first magnetic core 282 that is made of a ferrite bead core material. The first magnetic core 282 defines a cavity 283 and an air gap 284. A second magnetic core 286 is located in the air gap 284. Flux 288 flows through the first and second magnetic cores 282 and 286, respectively, as shown by the dotted lines. In some implementations, the second magnetic core 258 has a permeability that is lower than the ferrite bead core material.

Figure 23:
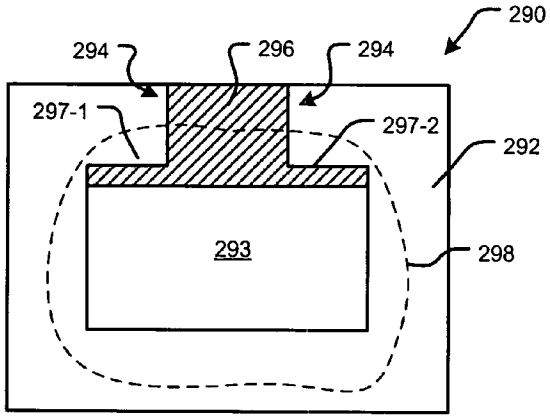
FIG. 23 illustrates a cross sectional view of a "C"-shaped first magnetic core including a ferrite bead core material and "T"-shaped second magnetic core, respectively.

Referring now to FIG. 23, a power inductor 290 includes a "C"-shaped first magnetic core 292 that is made of a ferrite bead core material. The first magnetic core 292 defines a cavity 293 and an air gap 294. A second magnetic core 296 is located in the air gap 294. In one implementation, the second magnetic core 296 extends into the air gap 294 and has a generally "T"-shaped cross section. The second magnetic core 296 extends along inner surfaces 297-1 and 297-2 of the first magnetic core 290 adjacent to the air gap 304. Flux 298 flows through the first and second magnetic cores 292 and 296, respectively, as shown by the dotted lines. In some implementations, the second magnetic core 258 has a permeability that is lower than the ferrite bead core material.

Figure 24:
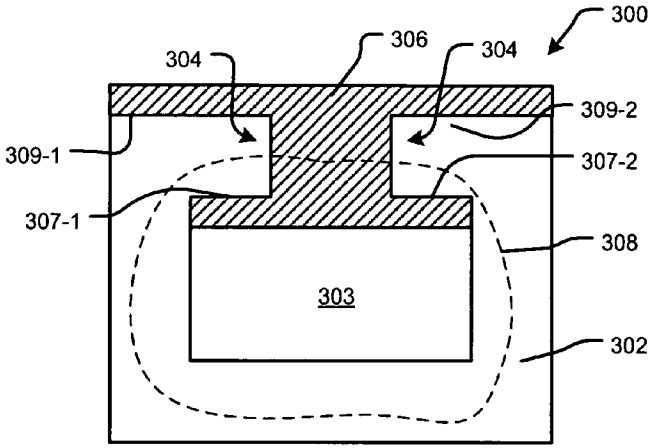
FIG. 24 illustrates a cross sectional view of a "C"-shaped first magnetic core including a ferrite bead core material and a self-locking "H"-shaped second magnetic core located in an air gap thereof.

Referring now to FIG. 24, a power inductor 300 includes a "C"-shaped first magnetic core 302 that is made of a ferrite bead core material. The first magnetic core 302 defines a cavity 303 and an air gap 304. A second magnetic core 306 is located in the air gap 304. The second magnetic core extends into the air gap 304 and outside of the air gap 304 and has a generally "H"-shaped cross section. The second magnetic core 306 extends along inner surfaces 307-1 and 307-2 and outer surfaces 309-1 and 309-2 of the first magnetic core 302 adjacent to the air gap 304. Flux 308 flows through the first and second magnetic cores 302 and 306, respectively, as shown by the dotted lines. In some implementations, the second magnetic core 258 has a permeability that is lower than the ferrite bead core material.

Referring now to FIG. 25, a power inductor 320 includes a "C"-shaped first magnetic core 322 that is made of a ferrite bead core material. The first magnetic core 322 defines a cavity 323 and an air gap 324. A second magnetic core 326 is located in the air gap 324. Flux 328 flows through the first and second magnetic cores 322 and 326, respectively, as shown by the dotted lines. The first magnetic core 322 and the second magnetic core 326 are self-locking. In some implementations, the second magnetic core 258 has a permeability that is lower than the ferrite bead core material.

Referring now to FIG. 26, a power inductor 340 includes an "O"-shaped first magnetic core 342 that is made of a ferrite bead core material. The first magnetic core 342 defines a cavity 343 and an air gap 344. A second magnetic core 346 is located in the air gap 344. Flux 348 flows through the first and second magnetic cores 342 and 346, respectively, as shown by the dotted lines. In some implementations, the second magnetic core 258 has a permeability that is lower than the ferrite bead core material.

Referring now to FIG. 27, a power inductor 360 includes an "O"-shaped first magnetic core 362 that is made of a ferrite bead core material. The first magnetic core 362 defines a cavity 363 and an air gap 364. The air gap 364 is partially defined by opposed "V"-shaped walls 365. A second magnetic core 366 is located in the air gap 364. Flux 368 flows through the first and second magnetic cores 362 and 366, respectively, as shown by the dotted lines. The first magnetic core 362 and the second magnetic core 366 are self-locking. In other words, relative movement of the first and second magnetic cores is limited in at least two orthogonal planes. While "V"-shaped walls 365 are employed, skilled artisans will appreciate that other shapes that provide a self-locking feature may be employed. In some implementations, the second magnetic core 258 has a permeability that is lower than the ferrite bead core material.

Referring now to FIG. 28, a power inductor 380 includes an "O"-shaped first magnetic core 382 that is made of a ferrite bead core material. The first magnetic core 382 defines a cavity 383 and an air gap 384. A second magnetic core 386 is located in the air gap 384 and is generally "H"-shaped. Flux 388 flows through the first and second magnetic cores 382 and 386, respectively, as shown by the dotted lines. The first magnetic core 382 and the second magnetic core 386 are self-locking. In other words, relative movement of the first and second magnetic cores is limited in at least two orthogonal planes. While the second magnetic core is "H"-shaped, skilled artisans will appreciate that other shapes that provide a self-locking feature may be employed. In some implementations, the second magnetic core 258 has a permeability that is lower than the ferrite bead core material.

In one implementation, the ferrite bead core material forming the first magnetic core is cut from a solid block of ferrite bead core material, for example using a diamond saw. Alternately, the ferrite bead core material is molded into a desired shape and then baked. The molded and baked material can then be cut if desired. Other combinations and/or ordering of molding, baking and/or cutting will be apparent to skilled artisans. The second magnetic core can be made using similar techniques.

One or both of the mating surfaces of the first magnetic core and/or the second magnetic core may be polished using conventional techniques prior to an attachment step. The first and second magnetic cores can be attached together using any suitable method. For example, an adhesive, adhesive tape, and/or any other bonding method can be used to attach the first magnetic core to the second core to form a composite structure. Skilled artisans will appreciate that other mechanical fastening methods may be used.

The second magnetic core is preferably made from a material having a lower permeability than the ferrite bead core material. In a preferred embodiment, the second magnetic core material forms less than 30% of the magnetic path. In a more preferred embodiment, the second magnetic core material forms less than 20% of the magnetic path. For example, the first magnetic core may have a permeability of approximately 2000 and the second magnetic core material may have a permeability of 20. The combined permeability of the magnetic path through the power inductor may be approximately 200 depending upon the respective lengths of magnetic paths through the first and second magnetic cores. In one implementation, the second magnetic core is formed using iron powder. While the iron powder has relatively high losses, the iron powder is capable of handling large magnetization currents.

Referring now to FIG. 29, in other implementations, the second magnetic core is formed using ferrite bead core material 420 with distributed gaps 424. The gaps can be filled with air, and/or other gases, liquids or solids. In other words, gaps and/or bubbles that are distributed within the second magnetic core material lower the permeability of the second magnetic core material. The second magnetic core may be fabricated in a manner similar to the first magnetic core, as described above. As can be appreciated, the second magnetic core material may have other shapes. Skilled artisans will also appreciate that the first and second magnetic cores described in conjunction with FIGS. 20-30 may be used in the embodiments shown and described in conjunction with FIGS. 1-19.

Figure 30:
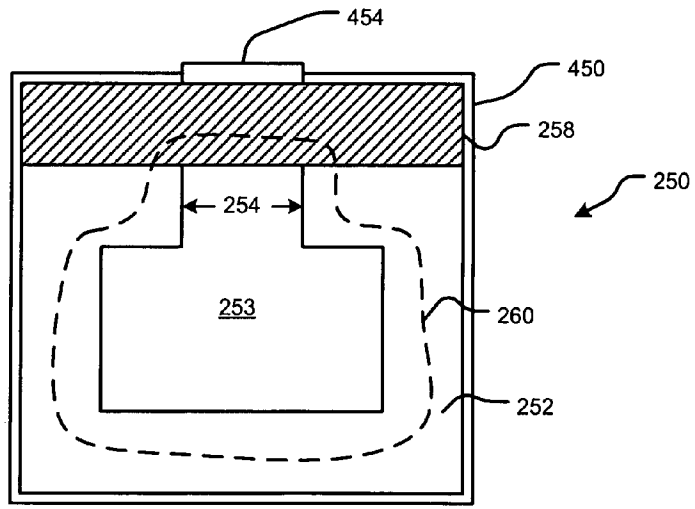
FIG. 30 illustrates first and second magnetic cores that are attached together using a strap.

Referring now to FIG. 30, a strap 450 is used to hold the first and second magnetic cores 252 and 258, respectively, together. Opposite ends of the strap may be attached together using a connector 454 or connected directly to each other. The strap 450 can be made of any suitable material such as metal or non-metallic materials.

Figure 31:
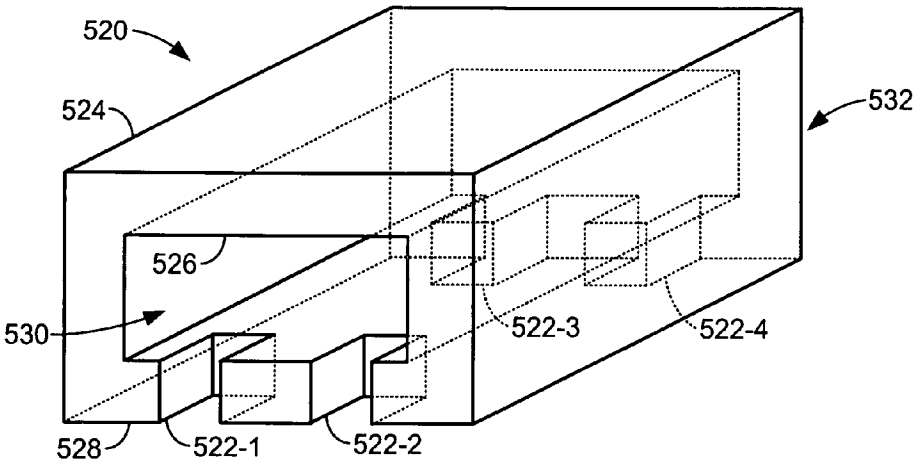
FIG. 31 is a perspective view showing the magnetic core material of a power inductor with one or more notches arranged in at least one side of the magnetic core material.

Referring now to FIG. 31, a power inductor 520 includes notches 522 arranged in a magnetic core material 524. For example, the magnetic core material 524 may include first, second, third, and fourth notches 522-1, 522-2, 522-3, and 522-4, respectively, (collectively notches 522). The notches 522 are arranged in the magnetic core material 524 between an inner cavity 526 and an outer side 528 of the magnetic core material 524. The first and second notches 522-1 and 522-2, respectively, are arranged at a first end 530 of the magnetic core material 524 and project inwardly. The third and fourth notches 522-3 and 522-4, respectively, are arranged at a second end 532 of the magnetic core material 524 and also project inwardly.

While the notches 522 in FIG. 31 are shown as rectangular in shape, those skilled in the art appreciate that the notches 522 may be any suitable shape including circular, oval, elliptical, and terraced. In an exemplary embodiment, the notches 522 are molded into the magnetic core material 524 during molding and before sintering. This approach avoids the additional step of forming the notches 522 following molding, which reduces time and cost. The notches 522 may also be cut and/or otherwise formed after molding and sintering if desired. While two pairs of notches are shown in FIG. 31, one notch, one pair of notches and/or additional notch pairs may be used. While the notches 522 are shown along one side of the magnetic core material 524, one or more notches 522 may be formed on one or more sides of the magnetic core material 524. Furthermore, one notch 222 may be formed on one side at one end of the magnetic core material 524 and another notch 522 may be formed on another side at the opposite end of the magnetic core material 524.

Figure 33:
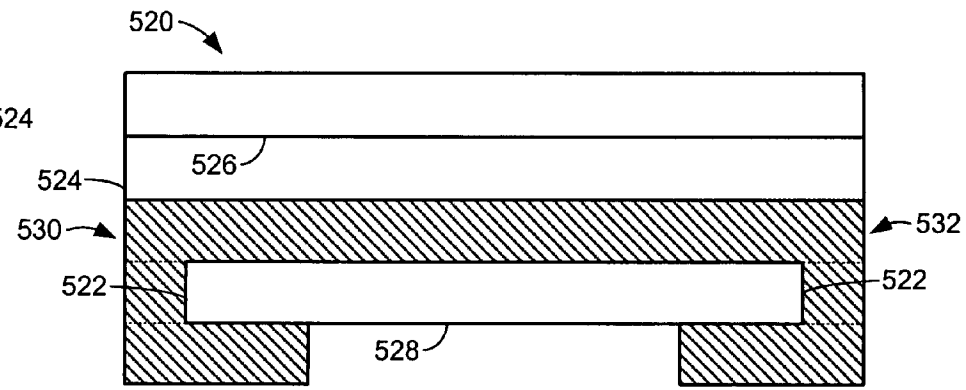
FIG. 33 is a side cross-sectional view of the power inductor in FIG. 32 showing ends of the conductors beginning and terminating along an outer side of the magnetic core material.
Figure 32:
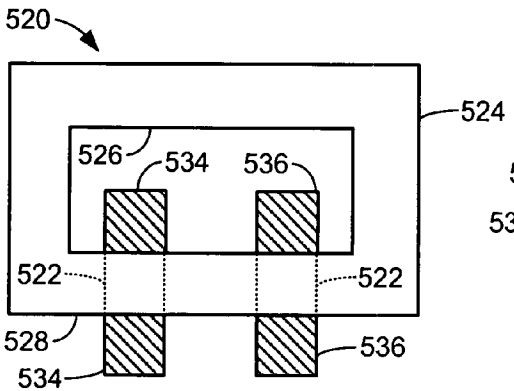
FIG. 32 is a cross-sectional view of the power inductor in FIG. 31 including one or more conductors that pass through the inner cavity of the magnetic core material and that are received by the notches.

Referring now to FIGS. 32 and 33, first and second conductors 534 and 536, respectively, pass through the inner cavity 526 along the bottom of the inner cavity 526 and are received by the notches 522. For example, the notches 522 may control a position of the first and second conductors 534 and 536, respectively. The first conductor 534 is received by the first and third notches 522-1 and 522-3, respectively, and the second conductor 536 is received by the second and fourth notches 522-2 and 522-4, respectively. The notches 522 preferably retain the first and second conductors 534 and 536, respectively, which prevents the first conductor 534 from contacting the second conductor 536 and avoids a short-circuit. In this case, insulation on the conductor is not required to insulate the first conductor 534 from the second conductor 536. Therefore, this approach avoids the additional step of removing insulation from the ends of insulated conductors when making connections, which reduces time and cost. However, insulation may be used if desired.

While not shown in FIGS. 31-33, the power inductor 520 may include one or more slotted air gaps arranged in the magnetic core material 524. For example, the one or more slotted air gaps may extend from the first end 530 to the second end 532 of the magnetic core material 524 as shown in FIG. 4. The power inductor 520 may also include an eddy current reducing material that is arranged adjacent to an inner opening and/or an outer opening of a slotted air gap as shown in FIGS. 6A and 6B. The slotted air gap may be arranged on the top of the magnetic core material 524 and/or one of the sides of the magnetic core material 524 as shown in FIGS. 10A and 10B.

A second cavity may be arranged in the magnetic core material 524 and a center section of the magnetic core material 524 may be arranged between the inner cavity 526 and the second cavity. In this case, the first conductor 534 may pass through the inner cavity 526 and second conductor 536 may pass through the second cavity. The first and second conductors, 534 and 536, respectively, may include an outer insulating later as shown in FIG. 16. The magnetic core material 524 may also comprise a ferrite bead core material. The power inductors of FIGS. 31-39 may also have other features shown in FIGS. 1-30.

Figure 34:
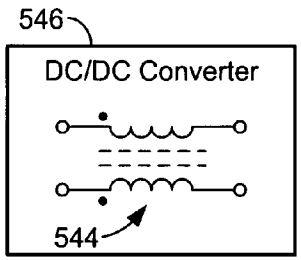
FIG. 34 is a functional block diagram and electrical schematic of the power inductor in FIGS. 32 and 33 implemented in an exemplary DC/DC converter.

Referring now to FIG. 34, the first and second conductors 534 and 536, respectively, may form a coupled inductor circuit 544. In one implementation, the mutual coupling is approximately equal to 1. In another implementation, the power inductor 520 is implemented in a DC/DC converter 546. The DC/DC converter 546 utilizes the power inductor 520 to transform DC at one voltage to DC at another voltage.

Figure 35:
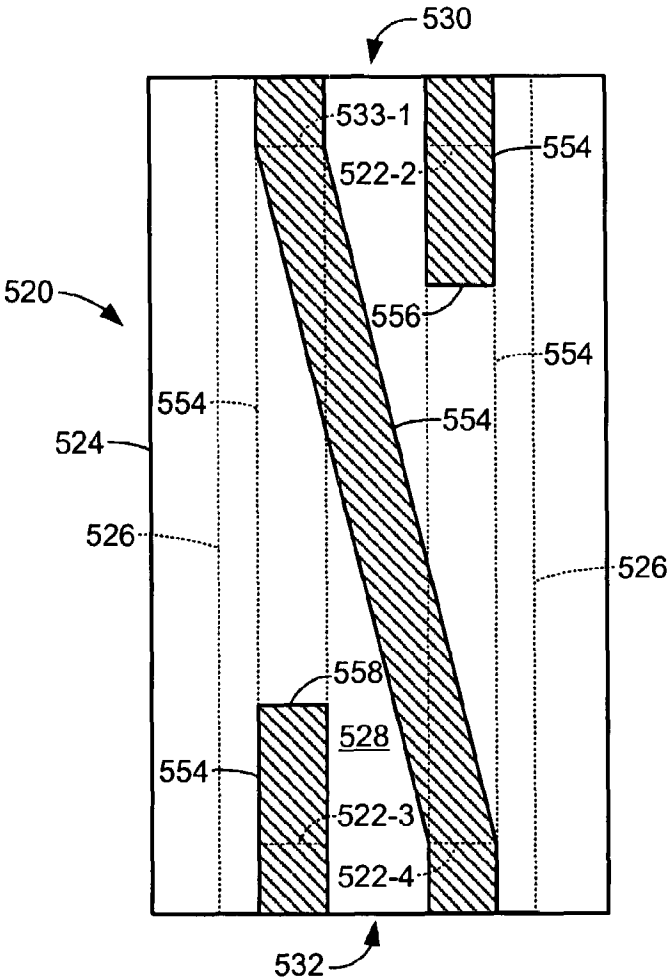
FIG. 35 is a bottom cross-sectional view of a power inductor including a single conductor that is threaded through the inner cavity multiple times and that is received by each of the notches.

Referring now to FIG. 35, a bottom cross-sectional view of the power inductor 520 is shown to include a single conductor 554 that passes through the inner cavity 526 twice and that is received by each of the notches 522. In an exemplary embodiment, a first end 556 of the conductor 554 begins along the outer side 528 of the magnetic core material 524 and is received by the second notch 522-2. The conductor 554 passes though the inner cavity 526 along the bottom of the inner cavity 526 from the second notch 522-2 and is received by the fourth notch 522-4. The conductor 554 is routed along the outer side 528 of the magnetic core material 524 from the fourth notch 522-4 and is received by the first notch 522-1. The conductor 554 passes through the inner cavity 526 along the bottom of the inner cavity 526 from the first notch 522-1 and is received by the third notch 522-3.

The conductor 554 continues from the third notch 522-3 and a second end 558 of the conductor 554 terminates along the outer side 528 of the magnetic core material 524. Therefore, the conductor 554 in FIG. 35 passes through the inner cavity 526 of the magnetic core material 524 at least twice and is received by each of the notches 522. The conductor 554 may be received by additional notches 522 in the magnetic core material 524 to increase the number of times that the conductor 554 passes through the inner cavity 526.

Figure 36:
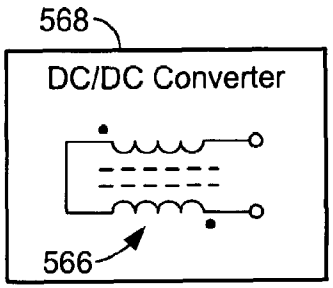
FIG. 36 is a functional block diagram and electrical schematic of the power inductor in FIG. 35 implemented in an exemplary DC/DC converter.

Referring now to FIG. 36, the conductor 554 may form a coupled inductor circuit 566. In one implementation, the power inductor 520 may be implemented in a DC/DC converter 568.

Figure 37:
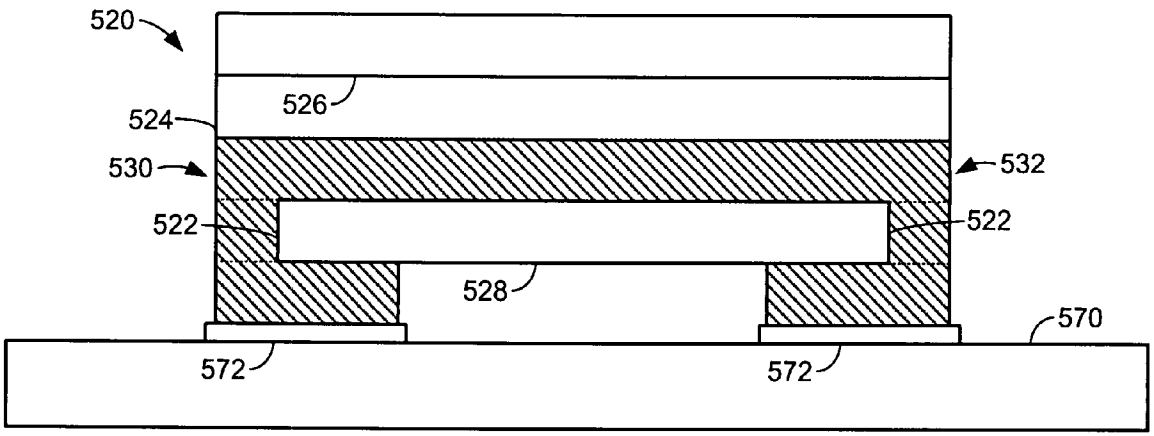
FIG. 37 is a side view of the power inductor in FIG. 33 surface mounted on a printed circuit board.
Figure 38:
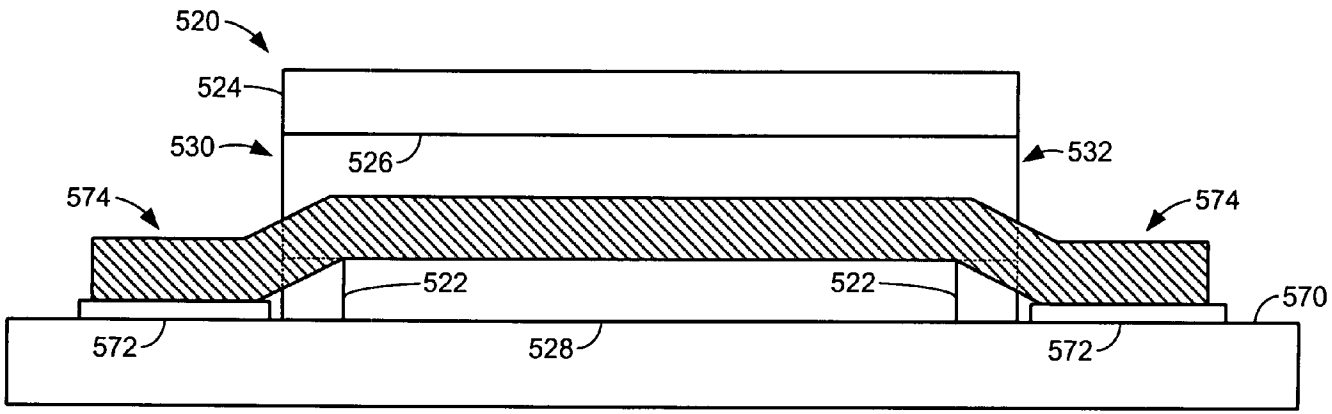
FIG. 38 is a side view of the power inductor in FIG. 33 surface mounted on a printed circuit board in a gull wing configuration.
Figure 39:
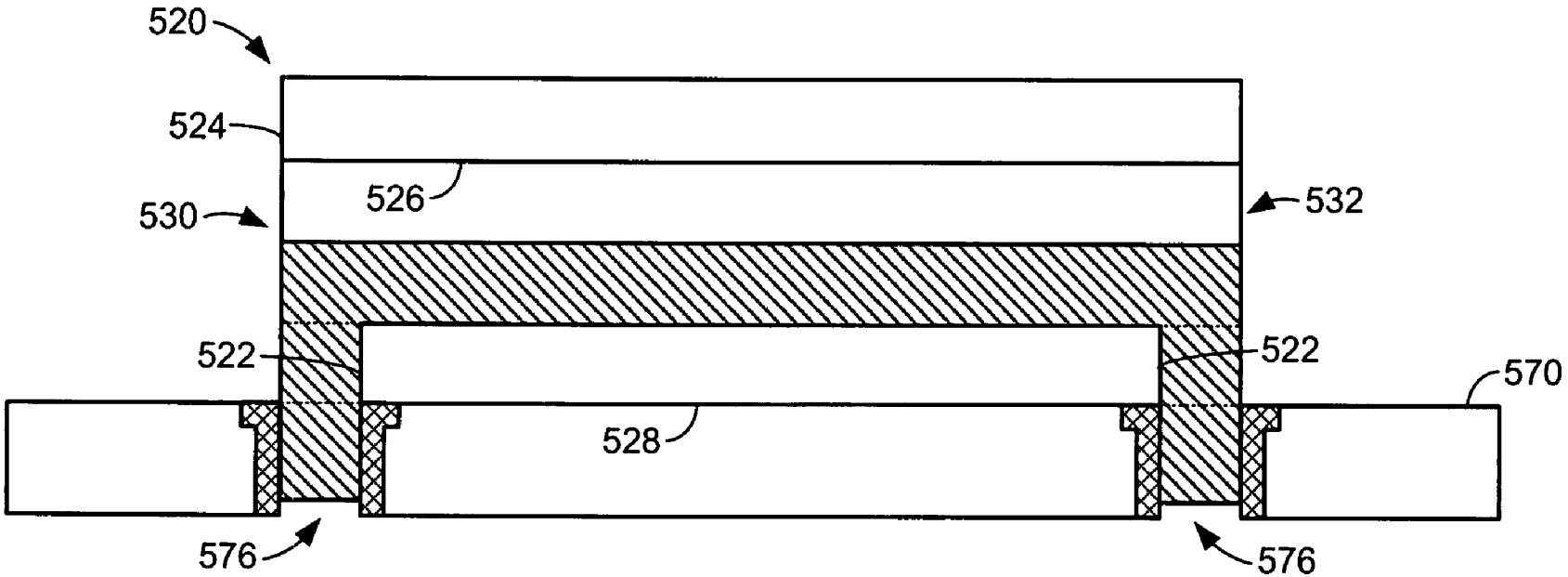
FIG. 39 is a side view of the power inductor in FIG. 33 connected to plated-through holes of a printed circuit board.

Referring now to FIGS. 37-38, the power inductor is surface mounted on a printed circuit board 570. In FIG. 39, the power inductor is mounted to plated through holes (PTHs) of the printed circuit board 570. In FIGS. 37-39, similar reference numbers are used as in FIGS. 32 and 33. In an exemplary embodiment and referring now to FIG. 37, the first and second ends of the first and second conductors 534 and 536, respectively, begin and terminate along the outer side 528 of the magnetic core material 524. This allows the power inductor 520 to be surface mounted on the printed circuit board 570. For example, the first and second ends of the first and, second conductors 534 and 536, respectively, may attach to solder pads 572 of the printed circuit board 570.

Alternatively and referring now to FIG. 38, the first and second ends of the first and second conductors 534 and 536, respectively, may extend beyond the outer side 528 of the magnetic core material 524. In this case, the power inductor 520 may be surface mounted on the printed circuit board 570 by attaching the first and second ends of the first and second conductors 534 and 536, respectively, to the solder pads 572 in a gull wing configuration 574.

Referring now to FIG. 39, the first ends and/or the second ends of the first and second conductors 534 and 536, respectively, may also extend and attach to plated-through holes (PTHs) 576 of the printed circuit board 570.

Figure 40:
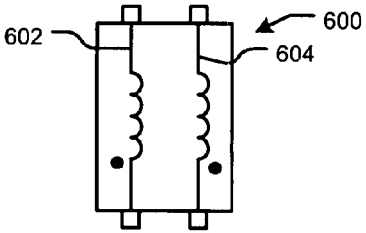
FIG. 40 illustrates the dot convention applied to a power inductor with two straight conductors.
Figure 41:
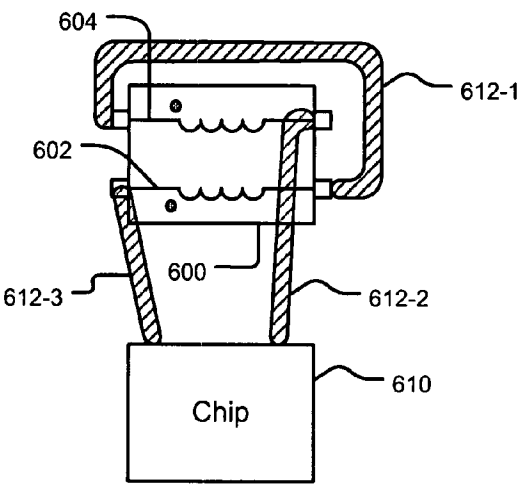
FIG. 41 illustrates a chip that is connected to the power inductor of FIG. 40.

Referring now to FIGS. 40 and 41, the dot convention is applied to a power inductor 600 in FIG. 40 including first and second conductors 602 and 604, respectively. To connect a chip 610 as shown in FIG. 41, printed circuit board (PCB) traces 612-1, 612-2 and 612-3 (collectively PCB traces 612) are sometimes employed. As can be seen in FIG. 41, wiring provided by the PCB traces 612 is not properly balanced. The imbalanced wiring tends to reduce the coefficient of mutual coupling and/or to increase losses due to skin effects at high frequencies.

Figure 43:
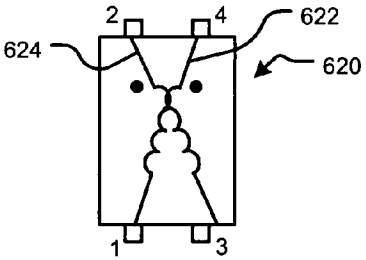
FIG. 43 illustrates a power inductor with crossing conductors.
Figure 42:
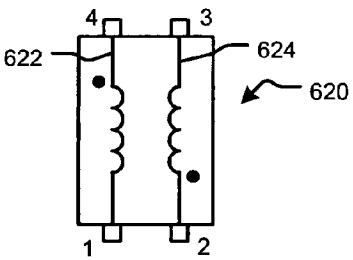
FIG. 42 illustrates the desired dot convention for a power inductor with two conductors.
Figure 44:
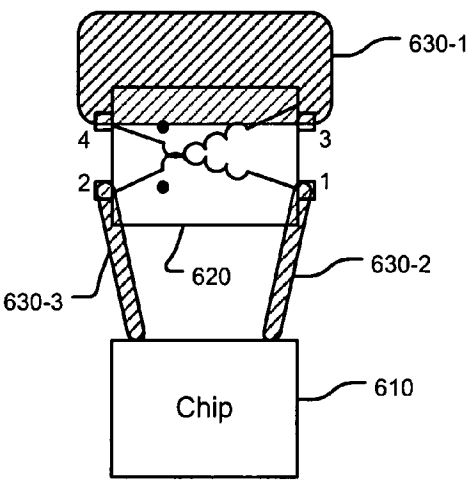
FIG. 44 illustrates a chip connected to the power inductors of FIG. 43.

Referring now to FIGS. 42, 43 and 44, a desired dot convention for a power inductor 620 including first and second conductors 622 and 624 is shown. In FIG. 43, the first and second conductors 622 and 624, respectively, are crossed to allow an improved connection to a chip. In FIG. 41, PCB traces 630-1, 630-2 and 630-3 (collectively PCB traces 630) are used to connect the conductors 622 and 624 to the power inductor 620. The PCB traces 630 are shorter and more balanced than those in FIG. 41, which allows the coefficient of mutual coupling to be closer to 1 and reduces losses due to skin effects at high frequencies.

Figure 46B:
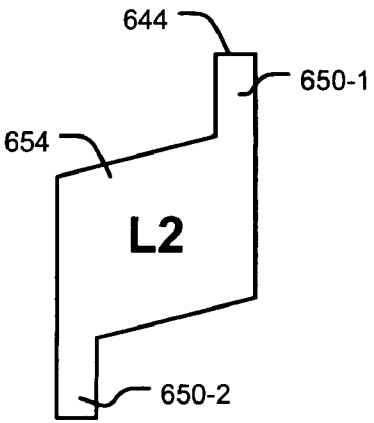
FIGS. 46A and 46B are plan views of the first and second lead frame conductors, respectively.
Figure 46A:
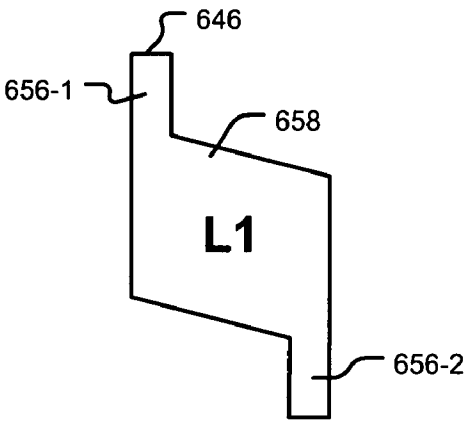
Figure 45:
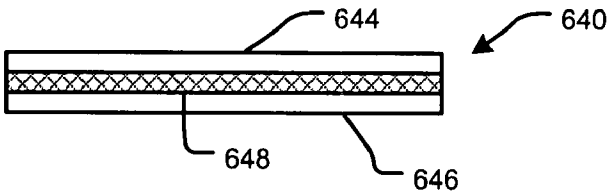
FIG. 45 is a side cross-sectional view of first and second lead frame conductors that are separated by insulating material.
Figure 46C:
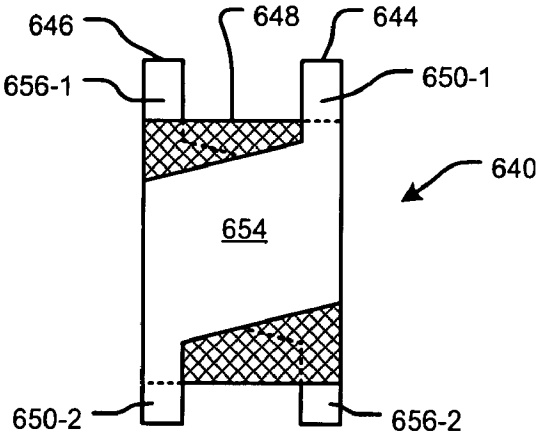
FIG. 46C is a plan view of a crossover conductor structure.
Figure 47A:
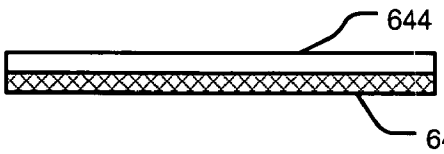
FIG. 47A is a side cross-sectional view of a first laminate including a first lead frame and insulating material.
Figure 47B:
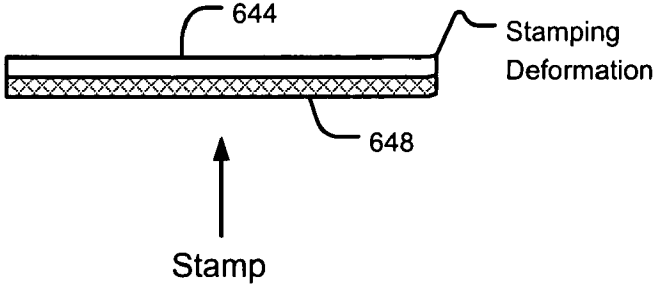
FIG. 47B illustrates stamping of the first laminate of FIG. 47A in a direction from the insulating material side towards the first lead frame.

Referring now to FIGS. 45-46, a crossed conductor structure 640 according to the present invention is shown. In FIG. 45, a side cross-sectional view of the crossed conductor structure 640 is shown to include first and second lead frames 644 and 646, respectively, that are separated by an insulating material 648. In FIGS. 46A and 46B, plan views of the first and second lead frames 644 and 646, respectively, are shown. The first lead frame 644 includes terminals 650-1 and 650-2 that extend from a body 654. The second lead frame 646 includes terminals 656-1 and 656-2 that extend from a body 658. While a generally "Z"-shaped configuration is shown for the lead frames 644 and 646, other shapes can be used. In FIG. 46C, a plan view of the assembled crossover conductor structure 640 is shown.

Several exemplary approaches for making the crossover conductor structure 640 will be described below. The first and second lead frames 644 and 646 may be initially stamped. The insulating material 648 is subsequently positioned there between. Alternately, the insulating material can be applied, sprayed, coated and/or otherwise applied to the lead frames. For example, one suitable insulating material includes enamel that can be readily applied in a controlled manner.

Alternately, the first and second lead frames 644 and 646 and the insulating material 648 can be attached together and then stamped. The first lead frame 644 (on a first side) is stamped approximately ½ of the thickness of the laminate from the first side towards a second side to define the shape and terminals of the first lead frame 644. The second lead frame 646 (on the second side) is stamped approximately ½ of the thickness of the laminate from the second side towards the first side to define the shape and terminals of the second lead frame 646.

Figure 49:
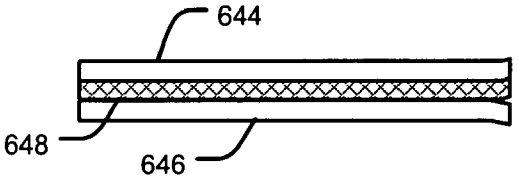
FIG. 49 illustrates attachment of the first laminate to the second lead frame to form a second laminate.
Figure 48A:
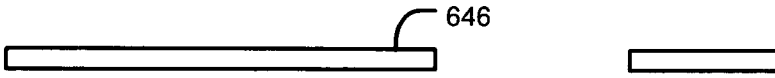
FIG. 48A is a side cross-sectional view of a second lead frame.
Figure 48B:
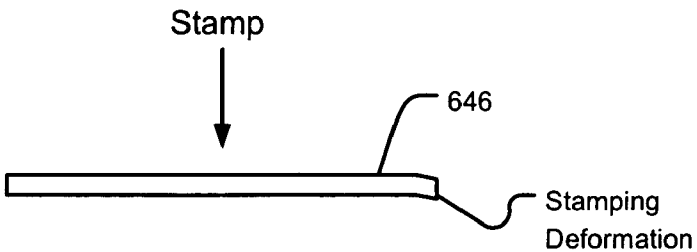
FIG. 48B illustrates stamping of the second lead frame.

Referring now to FIGS. 47A-49, an alternate method of construction is shown. The first lead frame 644 is initially attached to the insulating material 648 before stamping. The first lead frame 644 and the insulating material 648 are stamped in a direction indicated in FIG. 47B such that stamping deformation (if any) occurs in a direction away from the second lead frame (after assembly) to reduce the potential for short circuits. In other words, the stamping is done on the insulation side towards the first lead frame 644. Likewise the second lead frame 646 is stamped in the proper orientation to reduce the potential for short circuits. The stamp side of the second lead frame is arranged in contact with the insulating material. The stamping deformity (if any) in the first and second lead frames are outwardly directed. Referring now to FIG. 49. the first lead frame 644 and the insulating material 648 and the second lead frame 646 are arranged adjacent to each other to form a laminate.

Figures 50A, 50B:
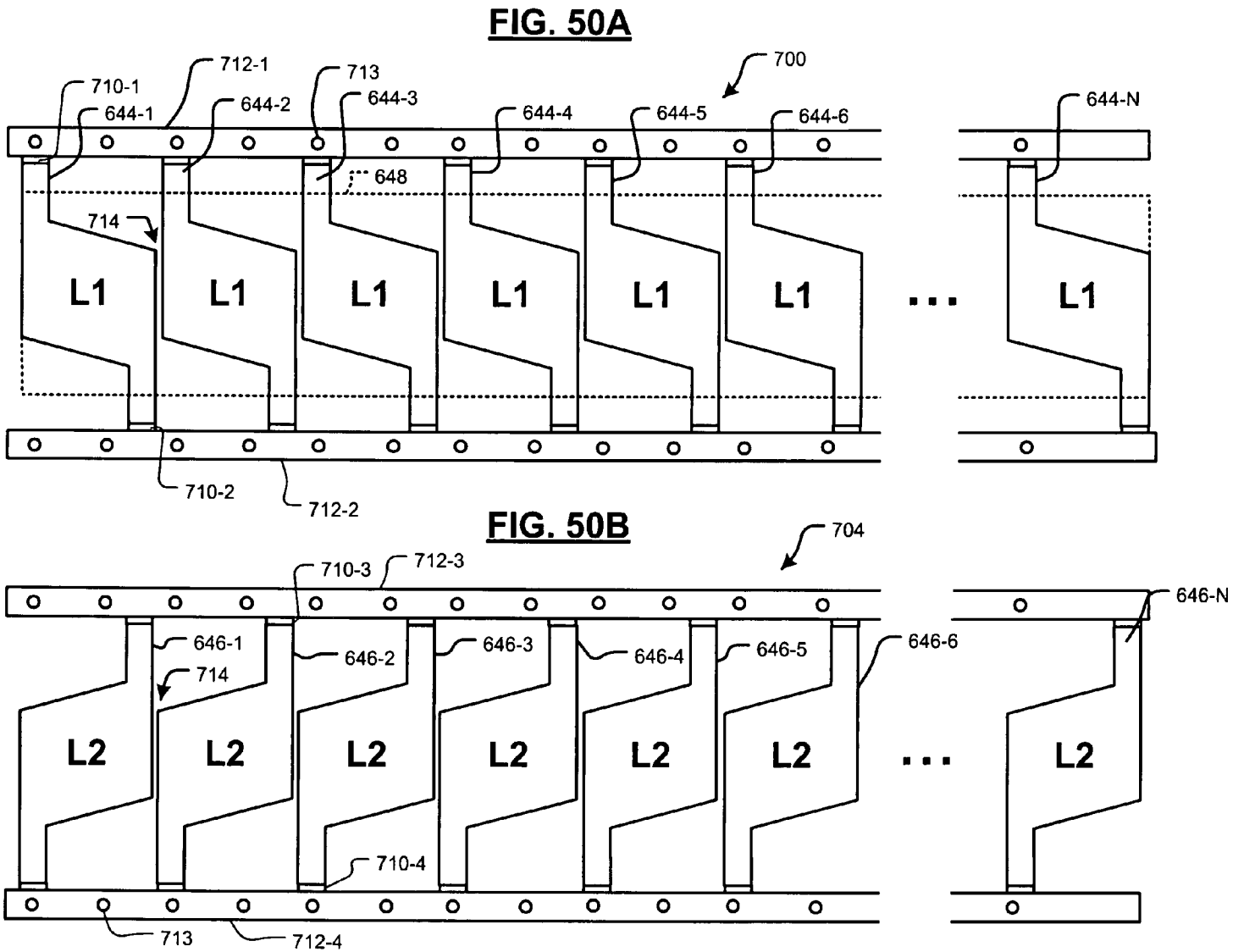
FIGS. 50A and 50B illustrate first and second arrays of lead frames, respectively.

FIG. 50A illustrates a first lead frame array 700 including first lead frames 644-1, 644-2, . . . , and 644-N, where N>1. In FIG. 50B, a second lead frame array 704 includes second lead frames 646-1, 646-2, and 646-N. As can be appreciated, the lead frame arrays 700 and 704 may alternatively include alternating first and second lead frames that are offset by one position. An insulating material 648 can be attached to the first and/or second lead frame array 700 and 704, respectively, and/or to individual lead frames. Alternately, an insulating material can be applied, sprayed and/or coated onto one or more surfaces of one and/or both of the lead frames. Tab portions 710-1, 710-2, 710-3 and 710-4 (collectively tab portions 710) may be used to attach the terminals or other portions of individual lead frames to feed strips 712-1, 712-2, 712-3, and 712-4 (collectively feed strips 712), respectively. The shape of the lead frames, the terminals and the tab portions are defined during stamping. In this embodiment, stamping is performed prior to joining the lead frames and insulating material. The feed strips 712 may optionally include holes 713 for receiving positioning pins of a drive wheel (not shown). Adjacent lead frames are optionally spaced from each other as identified at 714 and/or tab portions can be provided.

Figure 51C:
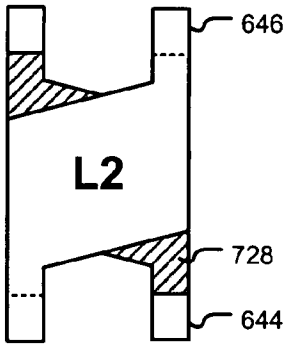
FIGS. 51A-51C show alternate lead frame arrays.
Figure 51A:
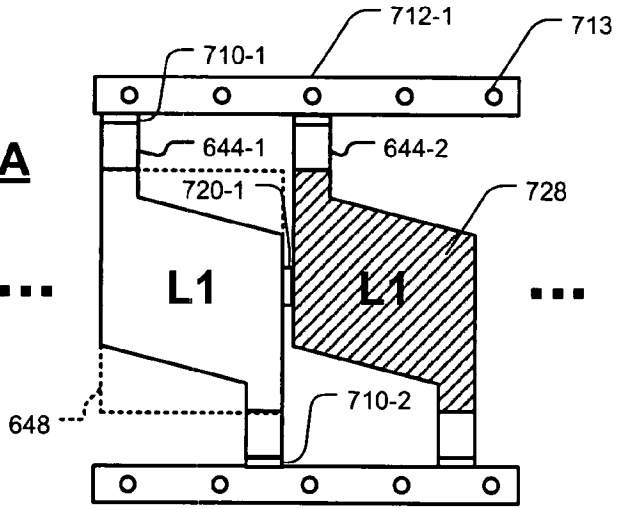
Figure 51B:
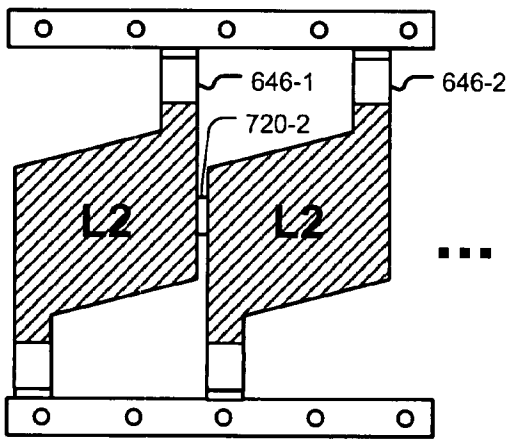

Referring now to FIGS. 51A-51C, additional tab portions 720-1 and 720-2 removably connect adjacent lead frames. Additionally, the lead frames are shown to include insulating material 728 that has been applied, sprayed and/or coated onto one or more surfaces of one and/or both of the lead frames. Alternately, insulating material 648 can be used. In the exemplary embodiment, facing surfaces of the lead frames are coated with the insulating material. For example, the insulating material can be enamel.

In addition to the methods described above, first and second lead frame arrays and insulating material can be arranged together and then stamped approximately ½ of a thickness thereof from both sides to define the shape of the lead frame arrays. Alternately, the insulating material can be applied to one or both lead frame arrays, stamped, and then assembled in an orientation that prevents stamping deformity from causing a short circuit as described above. Still other variations will be apparent to skilled artisans.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A method of fabricating a conducting crossover structure for a power inductor, the method comprising:

to form the conducting crossover structure:

stamping a first lead frame to define a first terminal and a second terminal;

stamping a second lead frame to define a first terminal and a second terminal;

locating an insulating material between and in contact with the first lead frame and the second lead frame to form a laminate; and positioning the conducting crossover structure in a cavity of the power inductor, wherein the first terminal and the second terminal of the first lead frame are located at first opposite diagonal corners of the laminate and the first terminal and the second terminal of the second lead frame are located at second opposite diagonal corners of the laminate.

2. The method of claim 1, further comprising:

connecting the first terminal of the first lead frame to the second terminal of the second lead frame; and connecting the second terminal of the first lead frame and the first terminal of the second lead frame to a chip.

3. The method of claim 1, wherein the first lead frame and the second lead frame include copper.

4. The method of claim 2, wherein:

stamping a distance of approximately ½ of a thickness of the laminate from a first side of the laminate to define the first terminal and the second terminal of the first lead frame; and stamping a distance of approximately ½ of the thickness of the laminate from a second side of the laminate to define the first terminal and the second terminal of the second lead frame.

5. The method of claim 1, wherein locating the insulating material between and in contact with the first lead frame and the second lead frame includes at least one of coating, spraying, applying, and attaching the insulating material.

* * * * *